US009508352B2

(12) United States Patent
Takeuchi et al.

(10) Patent No.: US 9,508,352 B2
(45) Date of Patent: Nov. 29, 2016

(54) AUDIO CODING DEVICE AND METHOD

(71) Applicant: FUJITSU LIMITED, Kawasaki-shi, Kanagawa (JP)

(72) Inventors: Shunsuke Takeuchi, Kawasaki (JP); Yohei Kishi, Kawasaki (JP); Masanao Suzuki, Yokohama (JP); Akira Kamano, Kawasaki (JP); Miyuki Shirakawa, Fukuoka (JP)

(73) Assignee: FUJITSU LIMITED, Kawasaki (JP)

( * ) Notice: Subject to any disclaimer, the term of this patent is extended or adjusted under 35 U.S.C. 154(b) by 174 days.

(21) Appl. No.: 14/090,546

(22) Filed: Nov. 26, 2013

(65) Prior Publication Data

US 2014/0236603 A1 Aug. 21, 2014

(30) Foreign Application Priority Data

Feb. 20, 2013 (JP) ..... 2013-031476

(51) Int. Cl.

| | |
|---|---|
| ***G10L 19/00*** | (2013.01) |
| ***G10L 21/00*** | (2013.01) |
| ***G10L 19/008*** | (2013.01) |
| *G10L 25/12* | (2013.01) |
| *G10L 19/04* | (2013.01) |

(52) U.S. Cl.

CPC ..... *G10L 19/008* (2013.01); *G10L 19/04* (2013.01); *G10L 25/12* (2013.01)

(58) Field of Classification Search

None

See application file for complete search history.

(56) References Cited

U.S. PATENT DOCUMENTS

| | | | | |
|---|---|---|---|---|
| 5,956,674 | A * | 9/1999 | Smyth | G10L 19/0208 704/200.1 |
| 2003/0187634 | A1* | 10/2003 | Li | G10L 19/02 704/200.1 |
| 2004/0044525 | A1* | 3/2004 | Vinton | H03G 5/165 704/224 |
| 2004/0049379 | A1* | 3/2004 | Thumpudi | G10L 19/008 704/205 |
| 2006/0140412 | A1* | 6/2006 | Villemoes | G10L 19/008 381/12 |

(Continued)

OTHER PUBLICATIONS

Extended European Search Report issued Apr. 24, 2014 in corresponding European Patent Application No. 13194815.0.

(Continued)

*Primary Examiner* — Huyen Vo
*Assistant Examiner* — Thuykhanh Le
(74) *Attorney, Agent, or Firm* — Staas & Halsey LLP

(57) ABSTRACT

An audio coding device that performs predictive coding on a third-channel signal included in a plurality of channels in an audio signal according to a first-channel signal and a second-channel signal, which are included in the plurality of channels, and to a plurality of channel prediction coefficients included in a coding book, the device includes a processor; and a memory which stores a plurality of instructions, which when executed by the processor, cause the processor to execute, selecting channel prediction coefficients corresponding to the first-channel signal and the second-channel signal so that an error, which is determined by a difference between the third-channel signal before predictive coding and the third-channel signal after predictive coding, is minimized; and controlling the first-channel signal or the second-channel signal so that the error is further reduced.

17 Claims, 13 Drawing Sheets

(56) References Cited

U.S. PATENT DOCUMENTS

2007/0223708 A1* 9/2007 Villemoes ..... H04S 3/004 381/17
2009/0110208 A1* 4/2009 Choo ..... G10L 25/93 381/71.1
2010/0262421 A1* 10/2010 Chong ..... G10L 19/008 704/203
2010/0318368 A1* 12/2010 Thumpudi ..... G10L 19/032 704/500
2011/0010168 A1* 1/2011 Yu ..... G10L 19/093 704/219
2011/0022402 A1* 1/2011 Engdegard ..... H04S 7/30 704/501
2011/0173005 A1* 7/2011 Hilpert ..... G10L 19/008 704/500
2011/0200198 A1* 8/2011 Grill ..... G10L 19/18 381/23
2011/0202354 A1* 8/2011 Grill ..... G10L 19/008 704/500
2011/0202355 A1* 8/2011 Grill ..... G10L 19/18 704/500
2012/0185257 A1* 7/2012 Oh ..... G10L 19/022 704/500
2012/0239408 A1* 9/2012 Oh ..... G10L 19/18 704/500
2012/0265523 A1* 10/2012 Greer ..... G10L 19/24 704/201
2012/0316885 A1* 12/2012 Gibbs ..... G10L 19/0208 704/500
2013/0030819 A1* 1/2013 Purnhagen ..... G10L 19/008 704/500
2014/0149124 A1* 5/2014 Choo ..... G10L 19/028 704/500

OTHER PUBLICATIONS

Gerard Hotho et al. "A Backward-Compatible Multichannel Audio Codec", IEEE Transactions on Audio, Speech and Language Processing, vol. 16, No. 1, pp. 83-93, Jan. 1, 2008.

Jurgen Herre et al. "MPEG Surround—The ISO/MPEG Standard for Efficient and Compatible Multi-Channel Audio Coding", Audio Engineering Society (AES) Convention 122nd; May 1, 2007.

Ted Painter et al. "Perceptual Coding of Digital Audio", Proceedings of the IEEE, vol. 88, No. 4, Apr. 1, 2000, XP011044355, ISSN: 0018-9219.

* cited by examiner

FIG. 2

| | | | | | | | | | | | | |
|---|---|---|---|---|---|---|---|---|---|---|---|---|
| idx | -20 | -19 | -18 | -17 | -16 | -15 | -14 | -13 | -12 | -11 | -10 | 201 |
| c [idx] | -2.0 | -1.9 | -1.8 | -1.7 | -1.6 | -1.5 | -1.4 | -1.3 | -1.2 | -1.1 | -1.0 | 202 |
| idx | -9 | -8 | -7 | -6 | -5 | -4 | -3 | -2 | -1 | 0 | 1 | 203 |
| c [idx] | -0.9 | -0.8 | -0.7 | -0.6 | -0.5 | -0.4 | -0.3 | -0.2 | -0.1 | 0.0 | 0.1 | 204 |
| idx | 2 | 3 | 4 | 5 | 6 | 7 | 8 | 9 | 10 | 11 | 12 | 205 |
| c [idx] | 0.2 | 0.3 | 0.4 | 0.5 | 0.6 | 0.7 | 0.8 | 0.9 | 1.0 | 1.1 | 1.2 | 206 |
| idx | 13 | 14 | 15 | 16 | 17 | 18 | 19 | 20 | 21 | 22 | 23 | 207 |
| c [idx] | 1.3 | 1.4 | 1.5 | 1.6 | 1.7 | 1.8 | 1.9 | 2.0 | 2.1 | 2.2 | 2.3 | 208 |
| idx | 24 | 25 | 26 | 27 | 28 | 29 | 30 | 209 | | | | |
| c [idx] | 2.4 | 2.5 | 2.6 | 2.7 | 2.8 | 2.9 | 3.0 | 210 | | | | |

200

FIG. 4

| idx | 0 | 1 | 2 | 3 | 4 | 5 | 6 | 7 |
|---|---|---|---|---|---|---|---|---|
| ICC[idx] | 1 | 0.937 | 0.84118 | 0.60092 | 0.36764 | 0 | -0.589 | -0.99 |

410

420

400

FIG. 5

| DIFFERENCE | idxicci |
|---|---|
| -7 | 11111111111111 |
| -6 | 11111111111110 |
| -5 | 111111111110 |
| -4 | 1111111110 |
| -3 | 1111110 |
| -2 | 11110 |
| -1 | 110 |
| 0 | 0 |

| DIFFERENCE | idxicci |
|---|---|
| 1 | 10 |
| 2 | 1110 |
| 3 | 111110 |
| 4 | 11111110 |
| 5 | 111111110 |
| 6 | 11111111110 |
| 7 | 1111111111110 |

500

FIG. 6

| | | | | | | | | | | | | |
|---|---|---|---|---|---|---|---|---|---|---|---|---|
| Idx | -15 | -14 | -13 | -12 | -11 | -10 | -9 | -8 | -7 | -6 | -5 | 610 |
| CLD[idx] | -150 | -45 | -40 | -35 | -30 | -25 | -22 | -19 | -16 | -13 | -10 | 620 |
| Idx | -4 | -3 | -2 | -1 | 0 | 1 | 2 | 3 | 4 | 5 | 6 | 630 |
| CLD[idx] | -8 | -6 | -4 | -2 | 0 | 2 | 4 | 6 | 8 | 10 | 13 | 640 |
| Idx | 7 | 8 | 9 | 10 | 11 | 12 | 13 | 14 | 15 | 650 | | |
| CLD[idx] | 16 | 19 | 22 | 25 | 30 | 35 | 40 | 45 | 150 | 660 | | |

600

AUDIO CODING DEVICE AND METHOD

CROSS-REFERENCE TO RELATED APPLICATION

This application is based upon and claims the benefit of priority of the prior Japanese Patent Application No. 2013-031476, filed on Feb. 20, 2013, the entire contents of which are incorporated herein by reference.

FIELD

The embodiments discussed herein are related to, for example, an audio coding device, an audio coding method, and an audio coding program.

BACKGROUND

To reduce the amount of data of multi-channel audio signals with three or more channels, methods of coding audio signals have been developed. Of these, one coding method standardized by the Moving Picture Experts Group (MPEG) is known as the MPEG Surround method. In the MPEG Surround method, 5.1-channel audio signals to be coded, for example, undergo time-frequency conversion and frequency signals resulting from the time-frequency conversion are down-mixed, creating three-channel frequency signals. When the three-channel frequency signals are down-mixed again, frequency signals corresponding to two-channel stereo signals are calculated. The frequency signals corresponding to the stereo signals are coded by the Advanced Audio Coding (AAC) method and Spectral Band Replication (SBR) method. In the MPEG Surround method, spatial information, which indicates spread or localization of sound is calculated at the time when the 5.1-channel signals are down-mixed to the three-channel signals and when the three-channel signals are down-mixed to the two-channel signals, after which the spatial information is coded. Accordingly, in the MPEG Surround method, stereo signals resulting from down-mixing multi-channel audio signals and spatial signal with a relatively small amount of data are coded. Therefore, the MPEG Surround method achieves higher compression efficiency than when a signal in each channel included in a multi-channel audio signal is independently coded.

In the MPEG Surround method, to reduce the amount of information to be coded, three-channel frequency signals are divided into a stereo frequency signal and two channel prediction coefficients, and each divided component is individually coded. The channel prediction coefficients are used to perform predictive coding on a signal in one of three channels according to signals in the remaining two channels. A plurality of channel prediction coefficients are stored in a table, which is a so-called coding book. The coding book is used to improve the efficiency of bits in use. When a coder and a decoder share a common predetermined coding book (or they each have a coding book created by a common method), it becomes possible to transmit more important information with less bits. At the time of decoding, the signal in one of the three channels is replicated according to the channel prediction coefficient described above. Therefore, it is desirable to select a channel prediction coefficient from the coding book at the time of coding.

In a disclosed method of selecting a channel prediction coefficient from the coding book, error defined by a difference between a channel signal before predictive coding and a channel signal resulting from the predictive coding is calculated by using each of all channel prediction coefficients stored in the coding book, and a channel prediction coefficient that minimizes the error in predictive coding is selected. A technology to calculate a channel prediction coefficient that minimizes error by using the least squares method is also disclosed in, for example, Japanese National Publication of International Patent Application No. 2008-517338.

SUMMARY

In accordance with an aspect of the embodiments, an audio coding device that performs predictive coding on a third-channel signal included in a plurality of channels in an audio signal according to a first-channel signal and a second-channel signal, which are included in the plurality of channels, and to a plurality of channel prediction coefficients included in a coding book, the device includes a processor; and a memory which stores a plurality of instructions, which when executed by the processor, cause the processor to execute, selecting channel prediction coefficients corresponding to the first-channel signal and the second-channel signal so that an error, which is determined by a difference between the third-channel signal before predictive coding and the third-channel signal after predictive coding, is minimized; and controlling the first-channel signal or the second-channel signal so that the error is further reduced.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which:

FIG. 2 illustrates an example of a quantization table (coding book) of prediction coefficients;

FIG. 4 illustrates an example of a quantization table of similarities;

FIG. 5 illustrates an example of a table that indicates relationships between inter-index differences and similarity codes;

FIG. 6 illustrates an example of a quantization table of differences in strength;

DESCRIPTION OF EMBODIMENTS

Examples of an audio coding device, an audio coding method, an audio coding computer program, and an audio decoding device according to an embodiment will be described in detail with reference to the drawings. These examples do not restrict the disclosed technology.

First Example

Figure 1:
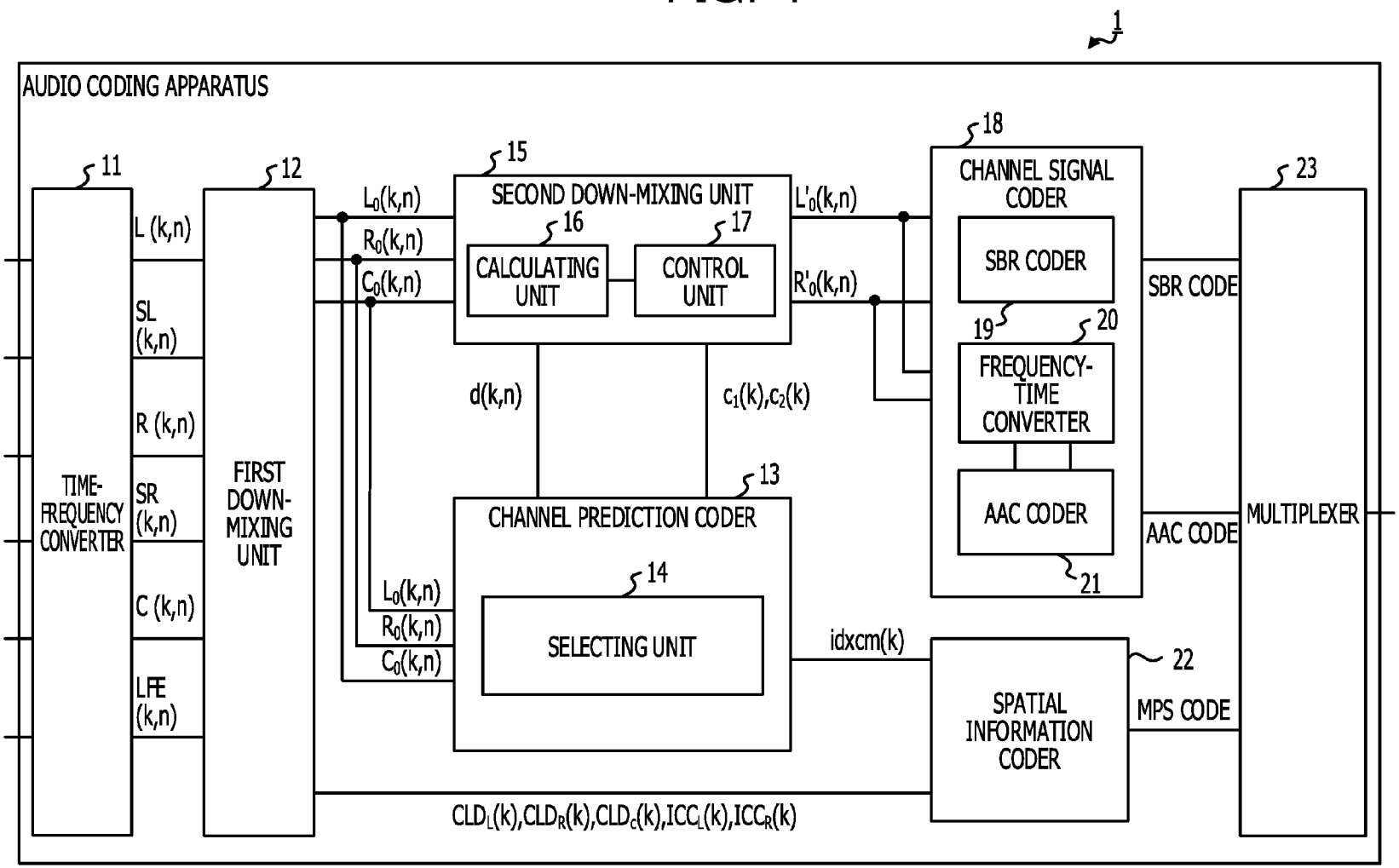
FIG. 1 is a functional block diagram of an audio coding device according to an embodiment.

FIG. 1 is a functional block diagram of an audio coding device 1 according to an embodiment. As illustrated in FIG. 1, the audio coding device 1 includes a time-frequency converter 11, a first down-mixing unit 12, a second down-mixing unit 15, a channel prediction coder 13, a channel signal coder 18, a spatial information coder 22, and a multiplexer 23.

The channel prediction coder 13 includes a selecting unit 14, and the second down-mixing unit 15 includes a calculating unit 16 and a control unit 17. The channel signal coder 18 includes a Spectral Band Replication (SBR) coder 19, a frequency-time converter 20, and an Advanced Audio Coding (AAC) coder 21.

These components of the audio coding device 1 are each formed as an individual circuit. Alternatively, these components of the audio coding device 1 may be installed into the audio coding device 1 as a single integrated circuit in which the circuits corresponding to these components are integrated. In addition, these components of the audio coding device 1 may be each a functional module that is implemented by a computer program executed by a processor included in the audio coding device 1.

The time-frequency converter 11 performs time-frequency conversion, one frame at a time, on a channel-specific signal in the time domain of a multi-channel audio signal entered into the audio coding device 1 so that the signal is converted to a frequency signal in the channel. In this embodiment, the time-frequency converter 11 uses a quadrature mirror filter (QMF) bank indicated in the equation in Eq. 1 below to convert a channel-specific signal to a frequency signal.

$$QMF(k,n)=\exp\left[j\frac{\pi}{128}(k+0.5)(2n+1)\right],\quad 0\le k<64,\quad 0\le n<128 \tag{1}$$

where n is a variable indicating time and k is a variable indicating a frequency band. The variable n indicates the nth time obtained when an audio signal for one frame is equally divided into 128 segments in the time direction. The frame length may take any value in the range of, for example, 10 ms to 80 ms. The variable k indicates the kth frequency band obtained when the frequency band of the frequency signal is equally divided into 64 segments. QMF(k, n) is a QMF used to output a frequency signal with frequency k at time n. The time-frequency converter 11 multiplies a one-frame audio signal in an entered channel by QMF(k, n) to create a frequency signal in the channel. The time-frequency converter 11 may use fast Fourier transform, discrete cosine transform, modified discrete cosine transform, or another type of time-frequency conversion processing to convert a channel-specific signal to a frequency signal.

Each time the time-frequency converter 11 calculates a channel-specific frequency signal one frame at a time, the time-frequency converter 11 outputs the channel-specific frequency signal to the first down-mixing unit 12.

Each time the first down-mixing unit 12 receives the frequency signals in all channels, the first down-mixing unit 12 down-mixes the frequency signals in these channels to create frequency signals in a left channel, central channel, and right channel. For example, the first down-mixing unit 12 calculates frequency signals in three channels below according to the equations in Eq. 2 below.

$$\begin{aligned}
&L_{in}(k,n)=L_{inRe}(k,n)+j\cdot L_{inIm}(k,n)\quad 0\le k<64, 0\le n<128\\
&L_{inRe}(k,n)=L_{Re}(k,n)+SL_{Re}(k,n)\\
&L_{inIm}(k,n)=L_{Im}(k,n)+SL_{Im}(k,n)\\
&R_{in}(k,n)=R_{inRe}(k,n)+j\cdot R_{inIm}(k,n)\quad 0\le k<64, 0\le n<128\\
&R_{inRe}(k,n)=R_{Re}(k,n)+SR_{Re}(k,n)\\
&R_{inIm}(k,n)=R_{Im}(k,n)+SR_{Im}(k,n)\\
&C_{in}(k,n)=C_{inRe}(k,n)+j\cdot C_{inIM}(k,n)\quad 0\le k<64, 0\le n<128\\
&C_{inRe}(k,n)=C_{Re}(k,n)+LFE_{Re}(k,n)\\
&C_{inIm}(k,n)=C_{Im}(k,n)+LFE_{Im}(k,n)
\end{aligned} \tag{2}$$

$L_{Re}$(k, n) indicates the real part of a front-left-channel frequency signal L(k, n), and $L_{Im}$(k, n) indicates the imaginary part of the front-left-channel frequency signal L(k, n). $SL_{Re}$(k, n) indicates the real part of a rear-left-channel frequency signal SL(k, n), and $SL_{Im}$(k, n) indicates the imaginary part of the rear-left-channel frequency signal SL(k, n). $L_{in}$ (k, n) indicates a left-channel frequency signal resulting from down-mixing. $L_{inRe}$(k, n) indicates the real part of the left-channel frequency signal, and $L_{inIm}$(k, n) indicates the imaginary part of the left-channel frequency signal.

Similarly, $R_{Re}$(k, n) indicates the real part of a front-right-channel frequency signal R(k, n), and $R_{Im}$(k, n) indicates the imaginary part of the front-right-channel frequency signal R(k, n). $SR_{Re}$(k, n) indicates the real part of a rear-right-channel frequency signal SR(k, n), and $SR_{Im}$(k, n) indicates the imaginary part of the rear-right-channel frequency signal SR(k, n). $R_{in}$ (k, n) indicates a right-channel frequency signal resulting from down-mixing. $R_{inRe}$(k, n) indicates the real part of the right-channel frequency signal, and $R_{inIm}$(k, n) indicates the imaginary part of the right-channel frequency signal.

Similarly again, $C_{Re}$(k, n) indicates the real part of a central-channel frequency signal C(k, n), and $C_{Im}$(k, n) indicates the imaginary part of the central-channel frequency signal C(k, n). $LFE_{Re}$(k, n) indicates the real part of a deep-bass-channel frequency signal LFE(k, n), and $LFE_{Im}$ (k, n) indicates the imaginary part of the deep-bass-channel frequency signal LFE(k, n). $C_{in}$ (k, n) indicates a central-channel frequency signal resulting from down-mixing. $C_{inRe}$ (k, n) indicates the real part of a central-channel frequency signal $C_{in}$(k, n), and $C_{inIm}$(k, n) indicates the imaginary part of the central-channel frequency signal $C_{in}$(k, n).

The first down-mixing unit 12 also calculates, for each frequency band, a difference in strength between frequency signals in two channels to be down-mixed, which indicates localization of sound, and similarity between these frequency signals, the similarity being information indicating spread of sound, as spatial information of these frequency signals. The spatial information calculated by the first down-mixing unit 12 is an example of three-channel spatial information. In this embodiment, the first down-mixing unit 12 calculates, for the left channel, a difference $CLD_L(k)$ in strength and similarity $ICC_L(k)$ in a frequency band k, according to the equation in Eq. 3 and Eq. 4 below.

$$CLD_L(k) = 10\log_{10}\left(\frac{e_L(k)}{e_{SL}(k)}\right) \tag{3}$$

$$ICC_L(k) = \mathrm{Re}\left\{\frac{e_{LSL}(k)}{\sqrt{e_L(k)\cdot e_{SL}(k)}}\right\}$$

$$e_L(k) = \sum_{n=0}^{N-1} |L(k,n)|^2 \tag{4}$$

$$e_{SL}(k) = \sum_{n=0}^{N-1} |SL(k,n)|^2$$

$$e_{LSL}(k) = \sum_{n=0}^{N-1} L(k,n)\cdot SL(k,n)$$

where N indicates the number of samples included in one frame in the time direction, N being 128 in this embodiment; $e_L(k)$ is an auto-correlation value of the front-left-channel frequency signal L(k, n); $e_{SL}(k)$ is an auto-correlation value of the rear-left-channel frequency signal SL(k, n); $e_{LSL}(k)$ is a cross-correlation value between the front-left-channel frequency signal L(k, n) and the rear-left-channel frequency signal SL(k, n).

Similarly, the first down-mixing unit 12 calculates, for the right channel, a difference $CLD_R(k)$ in strength and similarity $ICC_R(k)$ in the frequency band k, according to the equations in Eq. 5 and Eq. 6 below.

$$CLD_R(k) = 10\log_{10}\left(\frac{e_R(k)}{e_{SR}(k)}\right) \tag{5}$$

$$ICC_R(k) = \mathrm{Re}\left\{\frac{e_{RSR}(k)}{\sqrt{e_R(k)\cdot e_{SR}(k)}}\right\}$$

$$e_R(k) = \sum_{n=0}^{N-1} |R(k,n)|^2 \tag{6}$$

$$e_{SR}(k) = \sum_{n=0}^{N-1} |SR(k,n)|^2$$

$$e_{RSR}(k) = \sum_{n=0}^{N-1} L(k,n)\cdot SR(k,n)$$

where $e_R(k)$ is an auto-correlation value of the front-right-channel frequency signal R(k, n); $e_{SR}(k)$ is an auto-correlation value of the rear-right-channel frequency signal SR(k, n); $e_{RSR}(k)$ is a cross-correlation value between the front-right-channel frequency signal R(k, n) and the rear-right-channel frequency signal SR(k, n).

Similarly again, the first down-mixing unit 12 calculates, for the central channel, a difference $CLD_C(k)$ in strength in the frequency band k, according to the equations in Eq. 7 below.

$$CLD_C(k) = 10\log_{10}\left(\frac{e_C(k)}{e_{LFE}(k)}\right) \tag{7}$$

-continued $$e_C(k) = \sum_{n=0}^{N-1} |C(k,n)|^2$$

$$e_{LFE}(k) = \sum_{n=0}^{N-1} |LFE(k,n)|^2$$

where $e_C(k)$ is an auto-correlation value of the central-channel frequency signal C(k, n); $e_{LFE}(k)$ is an auto-correlation value of the deep-bass-channel frequency signal LFE (k, n).

Upon completion of the creation of the frequency signals in the three channels, the first down-mixing unit 12 further down-mixes the left-channel frequency signal and central-channel frequency signal to create a left-side stereo frequency signal. The first down-mixing unit 12 also down-mixes the right-channel frequency signal and central-channel frequency signal to create a right-side stereo frequency signal. For example, the first down-mixing unit 12 creates a left-side stereo frequency signal $L_0(k, n)$ and a right-side stereo frequency signal $R_0(k, n)$ according to the equation in Eq. 8 below. The first down-mixing unit 12 also calculates a central-channel signal $C_0(k, n)$, which is used to, for example, select a channel prediction coefficient included in the coding book, according to the equation below.

$$\begin{pmatrix} L_0(k,n) \\ R_0(k,n) \\ C_0(k,n) \end{pmatrix} = \begin{pmatrix} 1 & 0 & \frac{\sqrt{2}}{2} \\ 0 & 1 & \frac{\sqrt{2}}{2} \\ 1 & 1 & -\frac{\sqrt{2}}{2} \end{pmatrix} \begin{pmatrix} L_{in}(k,n) \\ R_{in}(k,n) \\ C_{in}(k,n) \end{pmatrix} \tag{8}$$

In (Eq. 8), $L_{in}(k, n)$, $R_{in}(k, n)$, and $C_{in}(k, n)$ are respectively the left-channel frequency signal, right-channel frequency signal, and central-channel frequency signal created by the first down-mixing unit 12. The left-side frequency signal $L_0(k, n)$ is created by combining the front-left-channel, rear-left-channel, central-channel, and deep-bass-channel frequency signals of the original multi-channel audio signal. Similarly, the right-side frequency signal $R_0(k, n)$ is created by combining the front-right-channel, rear-right-channel, central-channel, and deep-bass-channel frequency signals of the original multi-channel audio signal.

The first down-mixing unit 12 outputs the left-side frequency signal $L_0(k, n)$, right-side frequency signal $R_0(k, n)$, and central-channel frequency signal $C_0(k, n)$ to the second down-mixing unit 15. The first down-mixing unit 12 also outputs the differences $CLD_L(k)$, $CLD_R(k)$ and $CLD_C(k)$ in strength and similarities $ICC_L(k)$ and $ICC_R(k)$ to the spatial information coder 22.

The second down-mixing unit 15 receives the left-side frequency signal $L_0(k, n)$, right-side frequency signal $R_0(k, n)$, and central-channel frequency signal $C_0(k, n)$ from the first down-mixing unit 12 and down-mixes two of the frequency signals in these three-channel to create stereo frequency signals in two channels. For example, the two-channel stereo frequency signals are created from the left-side frequency signal $L_0(k, n)$ and right-side frequency signal $R_0(k, n)$. The second down-mixing unit 15 outputs control stereo frequency signals, which will be described later, to the channel signal coder 18. When the left-side frequency signal $L_0(k, n)$ and right-side frequency signal $R_0(k, n)$ in the equation in Eq. 8 above are rewritten as in Eq. 9.

$$L_0(k, n) = \left(L_{in\ Re}(k, n) + \frac{\sqrt{2}}{2} C_{in\ Re}(k, n)\right) + \left(L_{in\ Im}(k, n) + \frac{\sqrt{2}}{2} C_{in\ Im}(k, n)\right) \tag{9}$$

$$R_0(k, n) = \left(R_{in\ Re}(k, n) + \frac{\sqrt{2}}{2} C_{in\ Re}(k, n)\right) + \left(R_{in\ Im}(k, n) + \frac{\sqrt{2}}{2} C_{in\ Im}(k, n)\right)$$

The selecting unit 14 included in the channel prediction coder 13 selects, from the coding book, channel prediction coefficients for channel frequency signals in two channels that are to be down-mixed by the second down-mixing unit 15. If predictive coding is performed on the central-channel frequency signal $C_0(k, n)$ according to the left-side frequency signal $L_0(k, n)$ and right-side frequency signal $R_0(k, n)$, the second down-mixing unit 15 down-mixes the right-side frequency signal $R_0(k, n)$ and left-side frequency signal $L_0(k, n)$ to create two-channel stereo frequency signals. When performing predictive coding, the selecting unit 14 included in the channel prediction coder 13 selects, for each frequency band, channel prediction coefficients $c_1(k)$ and $c_2(k)$ that minimize the error $d(k, n)$ between the frequency signal before predictive coding and the frequency signal after predictive coding from the coding book, $c_1(k)$ and $c_2(k)$ being defined by the equations in Eq. 10 below according to $C_0(k, n)$, $L_0(k, n)$, and $R_0(k, n)$. The channel prediction coder 13 performs predictive coding on a central-channel frequency signal $C'_0(k, n)$ obtained after predictive coding in this way.

$$d(k, n) = \sum_k \sum_n \{|C_0(k, n) - C'_0(k, n)|^2\} \tag{10}$$

$$C'_0(k, n) = c_1(k) \cdot L_0(k, n) + c_2(k) \cdot R_0(k, n)$$

The equation in Eq. 10 may be represented as in Eq. 11 by using a real part and an imaginary part.

$$C'_0(k,n) = C'_{0Re}(k,n) + C'_{0Im}(k,n)$$

$$C'_{0Re}(k,n) = c_1 \times L_{0Re}(k,n) + c_2 \times R_{0Re}(k,n)$$

$$C'_{0Im}(k,n) = c_1 \times L_{0Im}(k,n) + c_2 \times R_{0Im}(k,n) \tag{11}$$

where $L_{0Re}(k, n)$ is the real part of $L_0(k, n)$, $L_{0Im}(k, n)$ is the imaginary part of $L_0(k, n)$, $R_{0Re}(k, n)$ is the real part of $R_0(k, n)$, and $R_{0Im}(k, n)$ is the imaginary part of $R_0(k, n)$.

The channel prediction coder 13 uses the channel prediction coefficients $c_1(k)$ and $c_2(k)$ included in the coding book to reference a quantization table (coding book), included in the channel prediction coder 13, that indicates correspondence between index values and typical values of the channel prediction coefficients $c_1(k)$ and $c_2(k)$. With reference to the quantization table, the channel prediction coder 13 determines the index values that are closest to the channel prediction coefficients $c_1(k)$ and $c_2(k)$ for each frequency band. A specific example will be described below. FIG. 2 illustrates an example of a quantization table (coding book) of prediction coefficients. In the quantization table 200 in FIG. 2, the columns on rows 201, 203, 205, 207, and 209 each indicate an index value. The columns on rows 202, 204, 206, 208, and 210 each indicate a representative value of a channel prediction coefficient corresponding to the index value in the column on the row in the same column 201, 203, 205, 207, or 209. If, for example, the value of the channel prediction coefficient $c_1(k)$ in the frequency band k is 1.2, the channel prediction coder 13 sets the index value for the channel prediction coefficient $c_1(k)$ to 12.

Next, the channel prediction coder 13 obtains an inter-index difference in the frequency direction for each frequency band. If, for example, the index value in the frequency band k is 2 and the index value in the frequency band (k−1) is 4, then the channel prediction coder 13 takes −2 as the inter-index difference in the frequency band k.

Next, the channel prediction coder 13 references a coding table that indicates correspondence between inter-index differences and channel prediction coefficient codes, and determines a channel prediction coefficient code $idxc_m(k)$ (m=1, 2 or m=1) corresponding to a difference in each frequency band k of channel prediction coefficients $c_m(k)$ (m=1, 2 or m=1). As with the similarity code, the channel prediction coefficient code may be, for example, a Huffman code, an arithmetic code, or another variable-length code that is more prolonged as the frequency at which the difference appears becomes higher. The quantization table and coding table are prestored in a memory (not illustrated) provided in the channel prediction coder 13. In FIG. 1, the channel prediction coder 13 outputs the channel prediction coefficient code $idxc_m(k)$ (m=1, 2) to the spatial information coder 22. The channel prediction coder 13 outputs the error $d(k, n)$ and channel prediction coefficients $c_1(k)$ and $c_2(k)$ to the second down-mixing unit 15.

The second down-mixing unit 15 receives the frequency signals in the three channels, which are the left-side frequency signal $L_0(k, n)$, right-side frequency signal $R_0(k, n)$, and central-channel frequency signal $C_0(k, n)$, from the first down-mixing unit 12. The second down-mixing unit 15 receives the error $d(k, n)$ and channel prediction coefficients $c_1(k)$ and $c_2(k)$ from the channel prediction coder 13. If, for example, the error $d(k, n)$ is not 0, the calculating unit 16 included in the second down-mixing unit 15 calculates a masking threshold threshold-$L_0(k, n)$ and a masking threshold threshold-$R_0(k, n)$, which respectively correspond to the left-side frequency signal $L_0(k, n)$ and right-side frequency signal $R_0(k, n)$. If the error $d(k, n)$ is 0, it suffices for the second down-mixing unit 15 to create stereo frequency signals in two channels from the left-side frequency signal $L_0(k, n)$ and right-side frequency signal $R_0(k, n)$ and outputs the created stereo frequency signals to the channel signal coder 18.

The masking threshold is a limit value of spectral power, up to which it is not perceptible to humans due to a masking effect. The masking threshold may be determined by a combination of a quiet masking threshold (qthr) and a dynamic masking threshold (dthr). The quiet masking threshold (qthr) is a limit value in the minimum audible range in which it is difficult for humans to acoustically perceive spectral power. A threshold described in the ISO/IEC13818-7 standard, which is a known technology, may be used as an example of the quiet masking threshold (qthr). When a signal with large spectral power is input at an arbitrary frequency, the dynamic masking threshold (dthr) is a limit value up to which spectral power in an adjacent peripheral band is not perceptible. The dynamic masking threshold (dthr) may be obtained by a method described in, for example, the ISO/IEC13818-7 standard, which describes a known technology.

Figure 3:
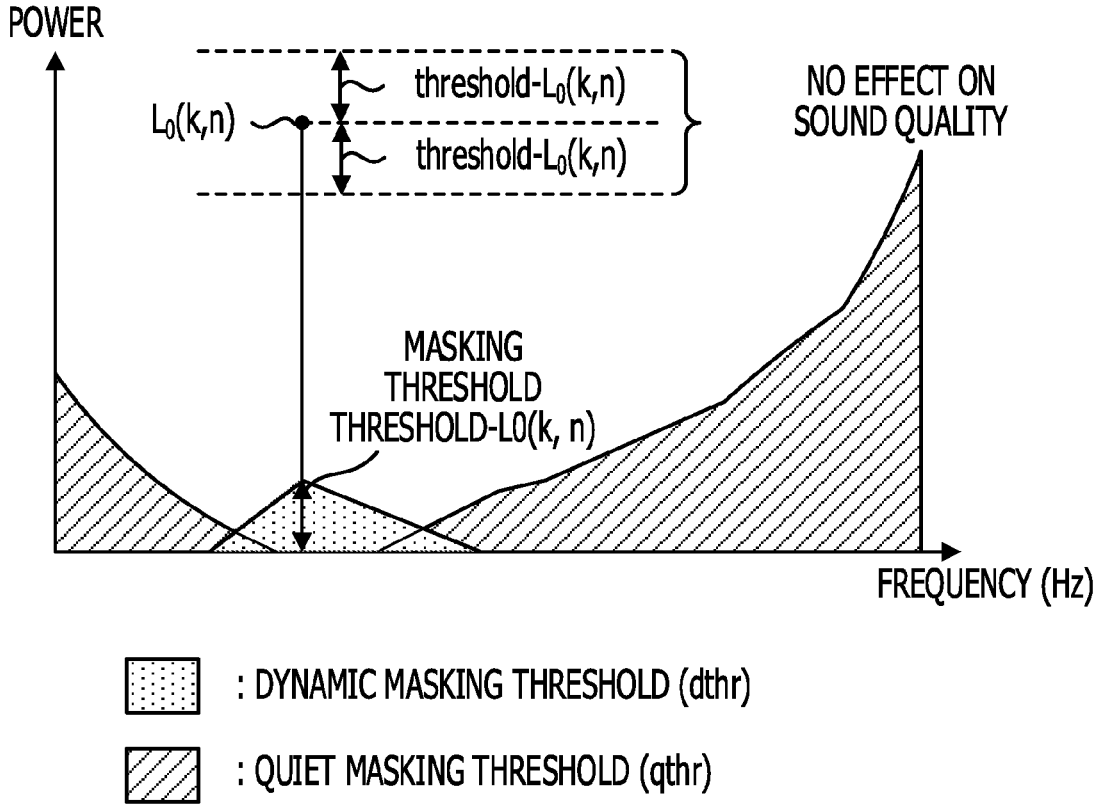
FIG. 3 is a conceptual diagram of masking thresholds.

FIG. 3 is a conceptual diagram of the masking thresholds. In FIG. 3, the left-side frequency signal $L_0(k, n)$ is taken as an example, but the same concept is applied to the right-side frequency signal $R_0(k, n)$, so detailed description of the right-side frequency signal $R_0(k, n)$ will be omitted. In FIG. 3, power of an arbitrary $L_0(k, n)$ is indicated, and the dynamic masking threshold (dthr) is determined according to the power. The quiet masking threshold (qthr) is uniquely determined. As described above, sounds less than the masking thresholds are not perceptible. The first example uses this principle to control the left-side frequency signal $L_0(k, n)$ and right-side frequency signal $R_0(k, n)$ within a range in which sound quality is not affected. Specifically, even if the left-side frequency signal $L_0(k, n)$ is freely controlled, if the range indicated by the masking threshold threshold-$L_0(k, n)$ is not exceeded, subjective sound quality is not affected. Although, in the first example, a masking threshold is taken as an example of a threshold that does not affect subjective sound quality, a parameter other than the masking threshold may also be used. The masking threshold threshold-$L_0(k, n)$ and masking threshold threshold-$R_0(k, n)$ may be calculated by using the equations in Eq. 12 below.

$$\text{threshold}-L_0(k,n)=\max(q\text{thr}(k,n),d\text{thr}(k,n))$$

$$\text{threshold}-R_0(k,n)=\max(q\text{thr}(k,n),d\text{thr}(k,n)) \tag{12}$$

The calculating unit 16 outputs the calculated masking threshold threshold-$L_0(k, n)$ and masking threshold threshold-$R_0(k, n)$ and the left-side frequency signal $L_0(k, n)$, right-side frequency signal $R_0(k, n)$, and central-channel frequency signal $C_0(k, n)$ in the three channels to the control unit 17. The calculating unit 16 may use only any one of the quiet masking threshold (qthr) and dynamic masking threshold (dthr) in Eq. 12 above to calculate the masking threshold threshold-$L_0(k, n)$ and masking threshold threshold-$R_0(k, n)$.

The control unit 17 calculates allowable control ranges $R_0\text{thr}(k, n)$ and $L_0\text{thr}(k, n)$, within which the left-side frequency signal $L_0(k, n)$ and right-side frequency signal $R_0(k, n)$ are not affected in subjective sound quality, from the left-side frequency signal $L_0(k, n)$, right-side frequency signal $R_0(k, n)$, and the masking thresholds threshold-$L_0(k, n)$ and threshold-$R_0(k, n)$ by a method described in, for example, the ISO/IEC13818-7 standard. The control unit 17 may calculate the allowable control ranges $R_0\text{thr}(k, n)$ and $L_0\text{thr}(k, n)$ by, for example, using the equations in Eq. 13 below.

$$L_0thr(k,n)=\left(\frac{\text{threshold}-L_0(k,n)}{L_0(k,n)}\right)\cdot L_0(k,n) \tag{13}$$

$$R_0thr(k,n)=\left(\frac{\text{threshold}-R_0(k,n)}{R_0(k,n)}\right)\cdot R_0(k,n)$$

The control unit 17 determines a control amount $\Delta L_0(k, n)$ by which the left-side frequency signal $L_0(k, n)$ is controlled and a control amount $\Delta R_0(k, n)$ by which the right-side frequency signal $R_0(k, n)$ is controlled from the allowable control ranges $R_0\text{thr}(k, n)$ and $L_0\text{thr}(k, n)$ calculated by using the equations in Eq. 13 above so that the error d' (k, n), which will be described later in detail, is minimized. The control amount $\Delta L_0(k, n)$ and control amount $\Delta R_0(k, n)$ may be determined by, for example, a method described below. First, the control unit 17 arbitrarily selects control amounts within the allowable control ranges $R_0\text{thr}(k, n)$ and $L_0\text{thr}(k, n)$. For example, the control unit 17 arbitrarily selects the control amount $\Delta L_0(k, n)$ and control amount $\Delta R_0(k, n)$ within ranges indicated by the equations in Eq. 14 below.

$$\Delta L_{0Re}(k,n)^2+\Delta L_{0Im}(k,n)^2\leq L_0\text{thr}(k,n)^2$$

$$\Delta R_{0Re}(k,n)^2+\Delta R_{0Im}(k,n)^2\leq R_0\text{thr}(k,n)^2 \tag{14}$$

where $\Delta L_{0Re}(k, n)$ is a control amount in the real part of $L_0(k, n)$, $\Delta L_{0Im}(k, n)$ is a control amount in the imaginary part of $L_0(k, n)$, $\Delta R_{0Re}(k, n)$ is a control amount in the real part of $R_0(k, n)$, and $\Delta R_{0Im}(k, n)$ is a control amount in the imaginary part of $R_0(k, n)$.

Next, the control unit 17 uses the equations in Eq. 15 below to calculate a central-channel signal $C''_0(k, n)$ after re-prediction control from control amounts $\Delta L_{0Re}(k, n)$ and $\Delta L_{0Im}(k, n)$ by which the left-side frequency signal $L_0(k, n)$ is controlled, control amounts $\Delta R_{0Re}(k, n)$ and $\Delta R_{0Im}(k, n)$ by which the right-side frequency signal $R_0(k, n)$ is controlled, and the channel prediction coefficients $c_1(k)$ and $c_2(k)$.

$$C''_{0Re}(k,n)=c_1\times(L_{0Re}(k,n)+\Delta L_{0Re}(k,n))+c_2\times(R_{0Re}(k,n)+\Delta R_{0Re}(k,n))$$

$$C''_{0Im}(k,n)=c_1\times(L_{0Im}(k,n)+\Delta L_{0Im}(k,n))+c_2\times(R_{0Im}(k,n)+\Delta R_{0Im}(k,n)) \tag{15}$$

where $L_{0Re}(k, n)$ is the real part of $L_0(k, n)$, $L_{0Im}(k, n)$ is the imaginary part of $L_0(k, n)$, $R_{0Re}(k, n)$ is the real part of $R_0(k, n)$, and $R_{0Im}(k, n)$ is the imaginary part of $R_0(k, n)$.

The control unit 17 calculates the error d'(k, n) determined by a difference between the central-channel signal $C''_0(k, n)$ after re-prediction control and the central-channel signal $C_0(k, n)$ before predictive coding by using the equation in Eq. 16 below.

$$d'(k,n)=\{C_{0Re}(k,n)-C''_{0Re}(k,n)\}^2+\{C_{0Im}(k,n)-C''_{0Im}(k,n)\}^2 \tag{16}$$

where $C_{0Re}(k, n)$ is the real part of $C_0(k, n)$, $C_{0Im}(k, n)$ is the imaginary part of $C_0(k, n)$, $C''_{0Re}(k, n)$ is the real part of $RC''_0(k, n)$, and $C_{0Im}(k, n)$ is the imaginary part of $C''_0(k, n)$.

The control unit 17 uses the equations in Eq. 17 below to control the left-side frequency signal $L_0(k, n)$ and right-side frequency signal $R_0(k, n)$ according to the control amounts $\Delta L_{0Re}(k, n)$ and $\Delta L_{0Im}(k, n)$ that minimize the error d' (k, n) and to the control amounts $\Delta R_{0Re}(k, n)$ and $\Delta R_{0Im}(k, n)$, and creates a control left-side frequency signal $L'_0(k, n)$ and a control right-side frequency signal $R'_0(k, n)$.

$$L'_0(k,n)=L_{0Re'}(k,n)+L_{0Im'}(k,n)$$

$$R'_0(k,n)=R_{0Re'}(k,n)+R_{0Im'}(k,n)$$

$$L_{0Re'}(k,n)=L_{0Re}(k,n)+\Delta L_{0Re}(k,n) \tag{17}$$

$$L_{0Im'}(k,n)=L_{0Im}(k,n)+\Delta L_{0Im}(k,n)$$

$$R_{0Re'}(k,n)=R_{0Re}(k,n)+\Delta R_{0Re}(k,n)$$

$$R_{0Im'}(k,n)=R_{0Im}(k,n)+\Delta R_{0Im}(k,n)$$

The second down-mixing unit 15 outputs the control left-side frequency signal $L'_0(k, n)$ and control right-side frequency signal $R'_0(k, n)$ created by the control unit 17 to the channel signal coder 18 as the control stereo frequency signals. The control stereo frequency signal may be simply referred to as the stereo frequency signal.

The channel signal coder 18 receives the control stereo frequency signals from the second down-mixing unit 15 and codes the received control stereo frequency signals. As described above, the channel signal coder 18 includes the SBR coder 19, frequency-time converter 20, and AAC coder 21.

Each time the SBR coder 19 receives a control stereo frequency signal, the SBR coder 19 codes the high-frequency components, which are included in a high-frequency band, of the stereo frequency signal for each channel, according to the SBR coding method. Thus, the SBR coder 19 creates an SBR code. For example, the SBR coder 19 replicates the low-frequency components, which have a close correlation with the high-frequency components to be subject to SBR coding, of a channel-specific frequency signal, as disclosed in Japanese Laid-open Patent Publication No. 2008-224902. The low-frequency components are components of a channel-specific frequency signal included in a low-frequency band, the frequencies of which are lower than the high-frequency band in which the high-frequency components to be coded by the SBR coder 19 are included. The low-frequency components are coded by the AAC coder 21, which will be described later. The SBR coder 19 adjusts the electric power of the replicated high-frequency components so that the electric power matches the electric power of the original high-frequency components. The SBR coder 19 handles, as auxiliary information, original high-frequency components that make it fail to approximate high-frequency components even when low-frequency components are replicated because differences from low-frequency components are large. The SBR coder 19 performs coding by quantizing information that represents a positional relationship between the low-frequency components used in replication and their corresponding high-frequency components, an amount by which electric power has been adjusted, and the auxiliary information. The SBR coder 19 outputs the SBR code, which is the above coded information, to the multiplexer 23.

Each time the frequency-time converter 20 receives a control stereo frequency signal, the frequency-time converter 20 converts a channel-specific control stereo frequency signal to a stereo signal in the time domain. When, for example, the time-frequency converter 11 uses a QMF filter bank, the frequency-time converter 20 uses a complex QMF filter bank represented by the equation in Eq. 18 below to perform frequency-time conversion on the channel-specific control stereo frequency signal.

$$IQMF(k, n) = \frac{1}{64}\exp\left(j\frac{\pi}{128}(k+0.5)(2n-255)\right), \quad 0 \le k < 64, \quad 0 \le n < 128 \tag{18}$$

where IQMF(k, n) is a complex QMF that uses time n and frequency k as variables. When the time-frequency converter 11 is using fast Fourier transform, discrete cosine transform, modified discrete cosine transform, or another type of time-frequency conversion processing, the frequency-time converter 20 uses the inverse transform of the time-frequency conversion processing that the time-frequency converter 11 is using. The frequency-time converter 20 outputs, to the AAC coder 21, the channel-specific stereo signal resulting from the frequency-time conversion on the channel-specific frequency signal.

Each time the AAC coder 21 receives a channel-specific stereo signal, the AAC coder 21 creates an AAC code by coding the low-frequency components of the channel-specific stereo signal according to the AAC coding method. In this coding, the AAC coder 21 may use a technology disclosed in, for example, Japanese Laid-open Patent Publication No. 2007-183528. Specifically, the AAC coder 21 performs discrete cosine transform on the received channel-specific stereo signal to create a control stereo frequency signal again. The AAC coder 21 then calculates perceptual entropy (PE) from the recreated stereo frequency signal. PE indicates the amount of information used to quantize the block so that the listener does not perceive noise.

PE has a property that has a large value for an attack sound generated from, for example, a percussion or another sound the signal level of which changes in a short time. Accordingly, the AAC coder 21 shortens windows for frames that have a relatively large PE value and prolongs windows for blocks that have a relatively small PE value. For example, a short window has 256 samples and a long window has 2048 samples. The AAC coder 21 uses a window having a predetermined length to execute modified discrete cosine transform (MDCT) on a channel-specific stereo signal so that the channel-specific stereo signal is converted to MDCT coefficients. The AAC coder 21 then quantizes the MDCT coefficients and performs variable-length coding on the quantized MDCT coefficients. The AAC coder 21 outputs the variable-length coded MDCT coefficients and related information such as quantized coefficients to the multiplexer 23 as the AAC code.

The spatial information coder 22 creates an MPEG Surround code (referred to below as the MPS code) from the spatial information received from the first down-mixing unit 12 and the channel prediction coefficient code received from the channel prediction coefficient coder 13.

The spatial information coder 22 references a quantization table that indicates correspondence between similarity values and index values in the spatial information and determines, for each frequency band, the index value that is closest to similarity $ICC_i(k)$ (i=L, R, 0). The quantization table is prestored in a memory (not illustrated) provided in the spatial information coder 22 or another place.

FIG. 4 illustrates an example of the quantization table of similarity. In the quantization table 400 in FIG. 4, each cell in the upper row 410 indicates an index value and each cell in the lower row 420 indicates the typical value of the similarity corresponding to the index value in the same column. The range of values that may be taken as the similarity is from −0.99 to +1. If, for example, the similarity in the frequency band k is 0.6, the quantization table 400 indicates that the typical value of the similarity corresponding to an index value of 3 is closest to the similarity in the frequency band k. Accordingly, the spatial information coder 22 sets the index value in the frequency band k to 3.

Next, the spatial information coder 22 obtains inter-index differences in the frequency direction for each frequency band. If, for example, the index value in frequency k is 3 and the index value in the frequency band (k−1) is 0, then the spatial information coder 22 takes 3 as the inter-index difference in the frequency band k.

The spatial information coder 22 references a coding table that indicates correspondence between inter-index differences and similarity codes and determines a similarity code $idxicc_i(k)$ (i=L, R, 0) corresponding to a difference between indexes for each frequency band of the similarity $ICC_i(k)$ (i=L, R, 0). The coding table is prestored in the memory provided in the spatial information coder 22 or another place. The similarity code may be, for example, a Huffman code, an arithmetic code, or another variable-length code that is more prolonged as the frequency at which the difference appears becomes higher.

FIG. 5 illustrates an example of a table that indicates relationships between inter-index differences and similarity codes. In the example in FIG. 5, similarity codes are Huffman codes. In the coding table 500 in FIG. 5, each cell in the left column indicates a difference between indexes and each cell in the right column indicates a similarity code corresponding to the difference in the same row. If, for example, the difference between indexes for the similarity $ICC_L(k)$ in the frequency band k is 3, the spatial information coder 22 references the coding table 500 and sets a similarity code $idxicc_L(k)$ for the similarity $ICC_L(k)$ in the frequency band k to 111110.

The spatial information coder 22 references a quantization table that indicates correspondence between differences in strength and index values and determines, for each frequency band, the index value that is closest to a strength difference $CLD_j(k)$ (j=L, R, C, 1, 2). The spatial information coder 22 determines, for each frequency band, differences between indexes in the frequency direction. If, for example, the index value in the frequency band k is 2 and the index value in the frequency band (k−1) is 4, the spatial information coder 22 sets a difference between these indexes in the frequency band k to −2.

The spatial information coder 22 references a coding table that indicates correspondence between inter-index differences and strength difference codes and determines a strength difference code $idxcld_j(k)$ (j=L, R, C) for the difference in each frequency band k of the strength difference $CLD_j(k)$. As with the similarity code, the strength difference code may be, for example, a Huffman code, an arithmetic code, or another variable-length code that is more prolonged as the frequency at which the difference appears becomes higher. The quantization table and coding tables are prestored in the memory provided in the spatial information coder 22.

FIG. 6 illustrates an example of the quantization table of differences in strength. In the quantization table 600 in FIG. 6, the cells in rows 610, 630, and 650 indicate index values and the cells in rows 620, 640, and 660 indicate typical strength differences corresponding to the index values in the cells in the rows 610, 630, and 650 in the same columns. If, for example, the difference $CLD_L(k)$ in strength in the frequency band k is 10.8 dB, the typical value of the strength difference corresponding to an index value of 5 is closest to $CLD_L(k)$ in the quantization table 600. Accordingly, the spatial information coder 22 sets the index value for $CLD_L(k)$ to 5.

The spatial information coder 22 uses the similarity code $idxicc_i(k)$, strength difference code $idxcld_j(k)$, and channel prediction coefficient code $idxc_m(k)$ to create an MPS code. For example, the spatial information coder 22 places the similarity code $idxicc_i(k)$, strength difference code $idxcld_i(k)$, and channel prediction coefficient code $idxc_m(k)$ in a given order to create the MPS code. The given order is described in, for example, ISO/IEC 23003-1: 2007. The spatial information coder 22 outputs the created MPS code to the multiplexer 23.

Figure 7:
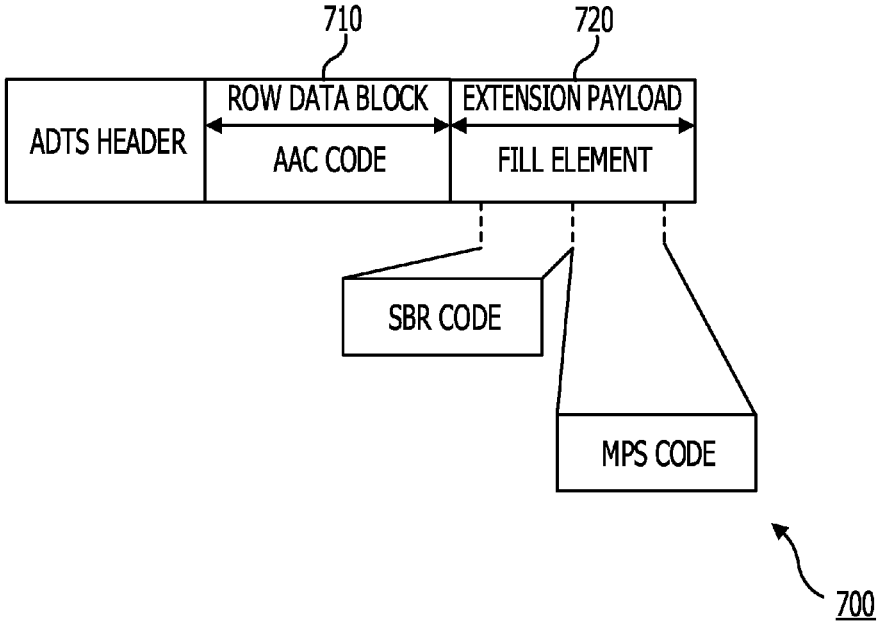
FIG. 7 illustrates an example of the format of data in which a coded audio signal is stored.

The multiplexer 23 places the AAC code, SBR code, and MPS code in a given order to multiplex them. The multiplexer 23 then outputs the coded audio signal resulting from multiplexing. FIG. 7 illustrates an example of the format of data in which a coded audio signal is stored. In the example in FIG. 7, the coded audio signal is created according to the MPEG-4 audio data transport stream (ADTS) format. In a coded data string 700 illustrated in FIG. 7, the AAC code is stored in a data block 710 and the SBR code and MPS code are stored in a partial area in a block 720, in which an ADTS-format fill element is stored.

Figure 8:
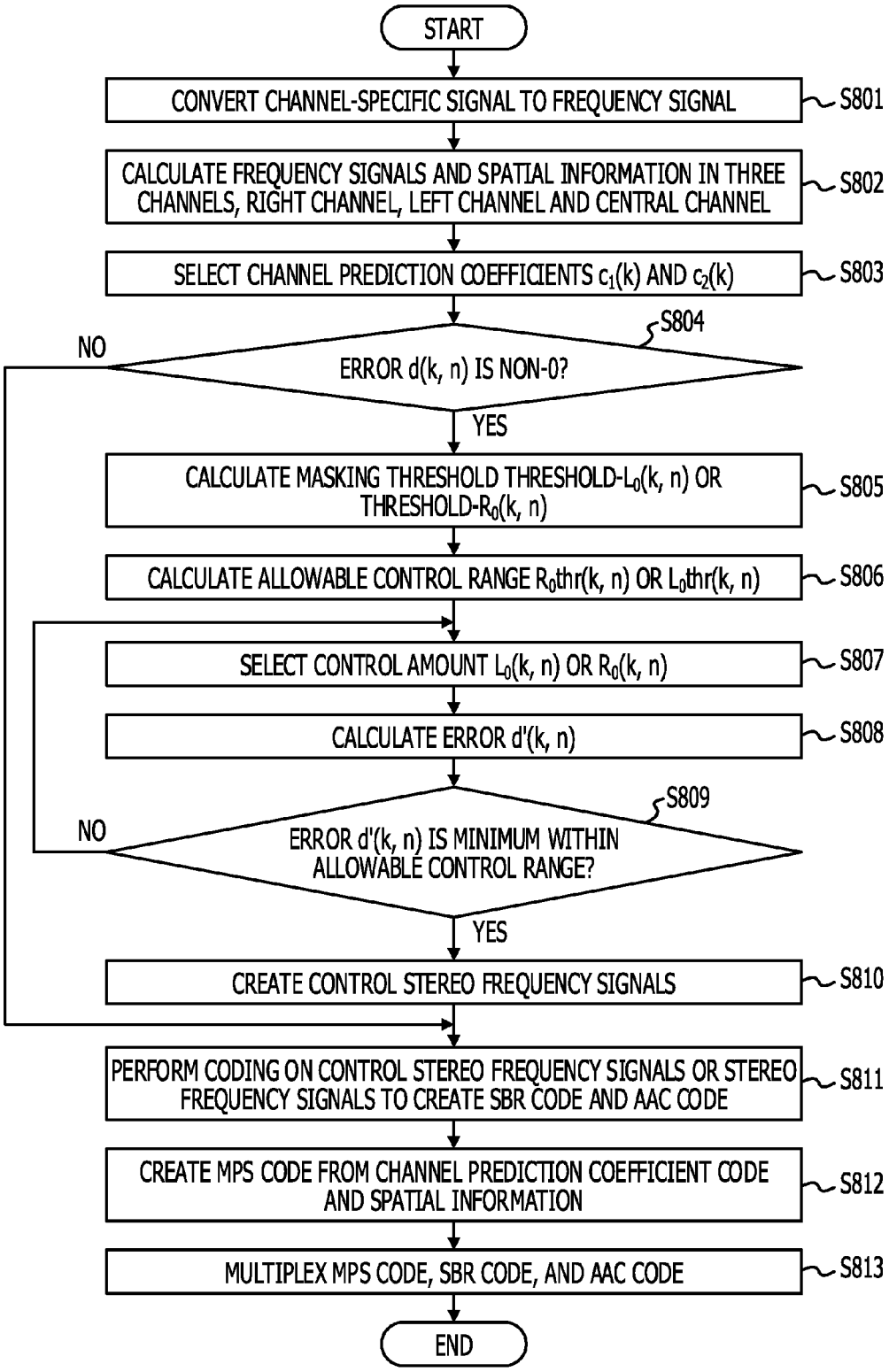
FIG. 8 is an operation flowchart in audio coding processing.

FIG. 8 is an operation flowchart in audio coding processing. The flowchart in FIG. 8 indicates processing to be carried out on a multi-channel audio signal for one frame. While continuously receiving multi-channel audio signals, the audio coding device 1 repeatedly executes the procedure for the audio coding processing in FIG. 8.

The time-frequency converter 11 converts a channel-specific signal to a frequency signal (step S801) and outputs the converted channel-specific frequency signal to the first down-mixing unit 12.

Next, the first down-mixing unit 12 down-mixes the frequency signals in all channels to create the frequency signals, $L_0(k, n)$, $R_0(k, n)$ and $C_0(k, n)$, in the three channels, which are the right channel, left channel and central channel, and calculates spatial information about the right channel, left channel, and central channel (step S802). The first down-mixing unit 12 outputs the three-channel frequency signals to the channel prediction coder 13 and second down-mixing unit 15.

The channel prediction coder 13 receives the left-side frequency signal $L_0(k, n)$, right-side frequency signal $R_0(k, n)$, and central-channel frequency signal $C_0(k, n)$ in the three channels from the first down-mixing unit 12. The selecting unit 14 included in the channel prediction coder 13 selects, from the coding book, the channel prediction coefficients $c_1(k)$ and $c_2(k)$ that minimize the error d(k, n) between the frequency signal before predictive coding and the frequency signal after predictive coding by using the equations in Eq. 10 above (step S803), as the channel prediction coefficients for frequency signals in two channels that are to be mixed. The channel prediction coder 13 outputs, to the spatial information coder 22, the channel prediction coefficient code $idxc_m(k)$ (m=1, 2) corresponding to the channel prediction coefficients $c_1(k)$ and $c_2(k)$. The channel prediction coder 13 outputs the error d(k, n) and channel prediction coefficients $c_1(k)$ and $c_2(k)$ to the second down-mixing unit 15.

The second down-mixing unit 15 receives the left-side frequency signal $L_0(k, n)$, right-side frequency signal $R_0(k, n)$, and central-channel frequency signal $C_0(k, n)$ in the three channels from the first down-mixing unit 12. The second down-mixing unit 15 also receives the error d(k, n) and channel prediction coefficients $c_1(k)$ and $c_2(k)$ from the channel prediction coder 13. The calculating unit 16 decides whether the error d(k, n) is 0 (step S804). If the error d(k, n) is 0 (the result in step S804 is No), the audio coding device 1 causes the second down-mixing unit 15 to create a stereo frequency signal and output the created stereo frequency signal to the channel signal coder 18, after which the audio coding device 1 advances the processing to step S811. If the error d(k, n) is not 0 (the result in step S804 is Yes), the calculating unit 16 calculates the masking threshold threshold-$L_0(k, n)$ or threshold-$R_0(k, n)$ by using the relevant equation in Eq. 12 above (step S805). The calculating unit 16 may calculate only one of the masking thresholds threshold-$L_0(k, n)$ and threshold-$R_0(k, n)$. In this case, later processing may be applied only to the frequency component for which a masking threshold has been calculated. The calculating unit 16 outputs, to the control unit 17, the calculated masking threshold threshold-$L_0(k, n)$ or threshold-$R_0(k, n)$ as well as the left-side frequency signal $L_0(k, n)$, right-side frequency signal $R_0(k, n)$, and central-channel frequency signal $C_0(k, n)$ in the three channels.

The control unit 17 calculates the allowable control range $R_0thr(k, n)$ or $L_0thr(k, n)$, within which the left-side frequency signal $L_0(k, n)$ or right-side frequency signal $R_0(k, n)$ is not affected in subjective sound quality, from the left-side frequency signal $L_0(k, n)$ or right-side frequency signal $R_0(k, n)$ as well as the masking thresholds threshold-$L_0(k, n)$ or threshold-$R_0(k, n)$ by using the relevant equation in Eq. 13 above (step S806). The control unit 17 determines the control amount $\Delta L_0(k, n)$ by which the left-side frequency signal $L_0(k, n)$ is controlled or the control amount $\Delta R_0(k, n)$ by which the right-side frequency signal $R_0(k, n)$ is controlled from the allowable control range $R_0thr(k, n)$ or $L_0thr(k, n)$ calculated by using the relevant equation in Eq. 13 above so that the error d' (k, n) is minimized. Accordingly, the control unit 17 arbitrarily selects the control amount $\Delta L_0(k, n)$ or control amount $\Delta R_0(k, n)$ within the ranges indicated by the relevant equation in Eq. 14 above (step S807). The control unit 17 calculates the error d'(k, n) determined by a difference between the central-channel signal $C''_0(k, n)$ after re-prediction control and the central-channel signal $C_0(k, n)$ before predictive coding by using the equation in Eq. 16 above (step S808).

The control unit 17 determines whether the error d' (k, n) is the minimum within the allowable control range (step S809). If the error d' (k, n) is not the minimum (the result in step S809 is No), the control unit 17 repeats the processing in steps S807 to S809. If the error d' (k, n) is the minimum (the result in step S809 is Yes), the control unit 17 uses the equations in Eq. 17 above to control the left-side frequency signal $L_0(k, n)$ and right-side frequency signal $R_0(k, n)$ according to the control amounts $\Delta L_{0Re}(k, n)$ and $\Delta L_{0Im}(k, n)$ and the control amounts $\Delta R_{0Re}(k, n)$ and $\Delta R_{0Im}(k, n)$ that minimize the error d' (k, n), and creates control stereo frequency signals by creating the control left-side frequency signal $L'_0(k, n)$ and control right-side frequency signal $R'_0(k, n)$ (step S810). The second down-mixing unit 15 outputs the control left-side frequency signal $L'_0(k, n)$ and control right-side frequency signal $R'_0(k, n)$ created by the control unit 17 to the channel signal coder 18 as the control stereo frequency signals.

The channel signal coder 18 performs SBR coding on the high-frequency components of the received channel-specific control stereo frequency signal or stereo frequency signal. The channel signal coder 18 also performs AAC coding on low-frequency components, which have not been subject to SBR coding (step S811). The channel signal coder 18 then outputs, to the multiplexer 23, the AAC code and the SBR code such as information that represents positional relationships between low-frequency components used for replication and their corresponding high frequency components.

The spatial information coder 22 creates an MPS code from the spatial information to be coded, the spatial information having been received from the first down-mixing unit 12, and the channel prediction coefficient code received from the second down-mixing unit 15 (step S812). The spatial information coder 22 then outputs the created MPS code to the multiplexer 23.

Finally, the multiplexer 23 multiplexes the created SBR code, AAC code, and MPS code to create a coded audio signal (step S813), after which the multiplexer 23 outputs the coded audio signal. The audio coding device 1 then terminates the coding processing.

The audio coding device 1 may execute processing in step S811 and processing in step S812 concurrently. Alternatively, the audio coding device 1 may execute processing in step S812 before executing processing in step S811.

Figure 9:
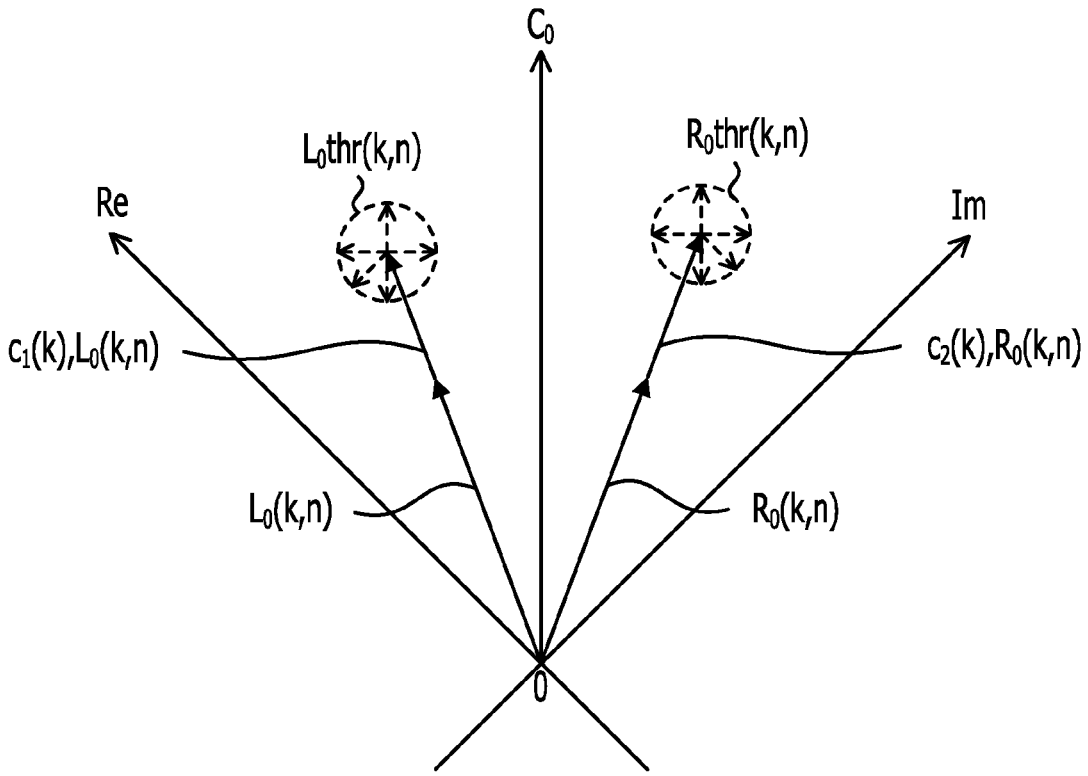
FIG. 9 is a conceptual diagram of predictive coding in a first example.

FIG. 9 is a conceptual diagram of predictive coding in the first example. In FIG. 9, the Re coordinate axis indicates the real parts of frequency signals and the Im coordinate axis indicates their imaginary parts. The left-side frequency signal $L_0(k, n)$, right-side frequency signal $R_0(k, n)$, and central-channel frequency signal $C_0(k, n)$ may be each represented by a vector having a real part and an imaginary part, as represented by, for example, the equations in Eq. 2, Eq. 8, and Eq. 9 above.

FIG. 9 schematically illustrates a vector of the left-side frequency, signal $L_0(k, n)$, a vector of the right-side frequency signal $R_0(k, n)$, and a vector of the central-channel frequency signal $C_0(k, n)$. In predictive coding, the fact that the central-channel frequency signal $C_0(k, n)$ may be subject to vector resolution by using the left-side frequency signal $L_0(k, n)$, right-side frequency signal $R_0(k, n)$, and channel prediction coefficients $c_1(k)$ and $c_2(k)$ is used.

When the channel prediction coder 13 selects, from the coding book, the channel prediction coefficients $c_1(k)$ and $c_2(k)$ that minimize the error d(k, n) between the central-channel frequency signal $C_0(k, n)$ before predictive coding and the central-channel frequency signal $C'_0(k, n)$ after predictive coding as described above, the channel prediction coder 13 may perform predictive coding on the central-channel frequency signal $C_0(k, n)$. The equations in Eq. 9 above mathematically represent this concept. In a method in which channel prediction coefficients are selected from the coding book, however, since the number of selectable channel prediction coefficients is finite, error in predictive coding may not converge to 0 in some cases. In the first example, however, the left-side frequency signal $L_0(k, n)$ and right-side frequency signal $R_0(k, n)$ may be controlled within the allowable control ranges $R_0thr(k, n)$ and $L_0thr(k, n)$, within which the left-side frequency signal $L_0(k, n)$ and right-side frequency signal $R_0(k, n)$ are not affected in subjective sound quality. If control is performed within the allowable control ranges rather than the ranges indicated by the quantization table 200 in FIG. 2, control may be performed by using arbitrary coefficients, so error in predictive coding may be substantially improved. For these reasons, the audio coding device 1 in the first example may suppress error in predictive coding without lowering the coding efficiency.

Second Example

When the error d(k, n) is not 0, the calculating unit 16, illustrated in FIG. 1, in the first example has calculated the masking threshold threshold-$L_0(k, n)$ corresponding to the left-side frequency signal $L_0(k, n)$ and the masking threshold threshold-$R_0(k, n)$ corresponding to the right-side frequency signal $R_0(k, n)$. However, when the error d(k, n) is not 0, the calculating unit 16 in the second example first calculates the masking threshold threshold-$C_0(k, n)$ corresponding to the central-channel frequency signal $C_0(k, n)$. The masking threshold threshold-$C_0(k, n)$ may be calculated by the same method as the method by which the above masking thresholds threshold-$L_0(k, n)$ and threshold-$R_0(k, n)$ are calculated, so its detailed description will be omitted.

The calculating unit 16 receives the channel prediction coefficients $c_1(k)$ and $c_2(k)$ from, for example, the control unit 17 and creates the central-channel frequency signal $C'_0(k, n)$ after predictive coding by using the equations in Eq. 10 above. If the difference between the absolute value of the central-channel frequency signal $C_0(k, n)$ and the absolute value of the central-channel frequency signal $C'_0(k, n)$ after predictive coding is smaller than the masking threshold threshold-$C_0(k, n)$, it may be considered that the error of the central-channel frequency signal $C'_0(k, n)$ after predictive coding does not affect subjective sound quality. In this case, the second down-mixing unit 15 creates stereo frequency signals in two channels from the left-side frequency signal $L_0(k, n)$ and right-side frequency signal $R_0(k, n)$ and outputs the created stereo frequency signals to the channel signal coder 18. If the difference between the absolute value of the central-channel frequency signal $C_0(k, n)$ and the absolute value of the central-channel frequency signal $C'_0(k, n)$ after predictive coding is larger than the masking threshold threshold-$C_0(k, n)$, it suffices for the audio coding device 1 to create a control stereo frequency signal by the method described in the first example. The masking threshold threshold-$C_0(k, n)$ may be referred to as a first threshold.

The audio coding device 1 in the second example may suppress error in predictive coding and may reduce a calculation load without lowering the coding efficiency.

Third Example

Although the control unit 17 illustrated in FIG. 1 controls both the left-side frequency signal $L_0(k, n)$ and the right-side frequency signal $R_0(k, n)$, it is possible to create a control stereo frequency signal by controlling only one of the left-side frequency signal $L_0(k, n)$ and right-side frequency signal $R_0(k, n)$. If, for example, the control unit 17 controls only the right-side frequency signal $R_0(k, n)$, then the control unit 17 uses only the equations related to $R_0(k, n)$ in Eq. 14 and Eq. 15 above to calculate the error d' (k, n) according to the equation in Eq. 16 and calculates $R'_0(k, n)$ in Eq. 17. The second down-mixing unit 15 outputs the control right-side frequency signal $R'_0(k, n)$ and left-side frequency signal $L_0(k, n)$ to the channel signal coder 18 as the control stereo frequency signals.

The audio coding device 1 in the third example may suppress error in predictive coding and may reduce a calculation load without lowering the coding efficiency.

Fourth Example

Figure 10:
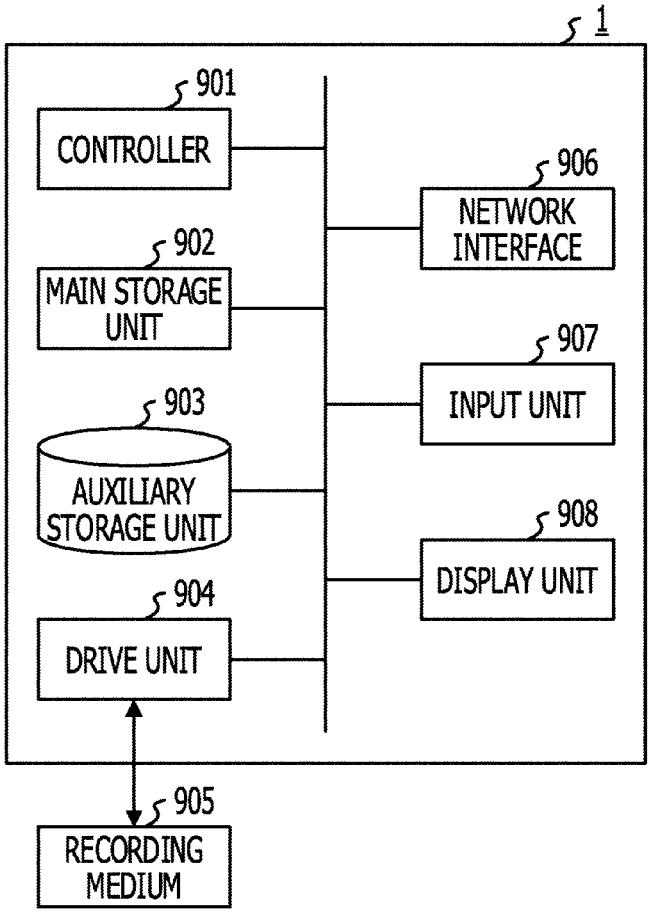
FIG. 10 illustrates the hardware structure of an audio coding device according to an embodiment.

FIG. 10 illustrates the hardware structure of the audio coding device 1 according to another embodiment. As illustrated in FIG. 10, the audio coding device 1 includes a controller 901, a main storage unit 902, an auxiliary storage unit 903, a drive unit 904, a network interface 906, an input unit 907, and a display unit 908. These units are mutually connected through a bus so that data may be transmitted and received.

The controller 901 is a central processing unit (CPU) that controls individual units and calculates or processes data in the computer. The controller 901 also functions as a calculating unit that executes programs stored in the main storage unit 902 and auxiliary storage unit 903; the controller 901 receives data from input unit 907, main storage unit 902, or auxiliary storage unit 903, calculates or processes the received data, and outputs the calculated or processed data to the display unit 908, main storage unit 902, auxiliary storage unit 903, or the like.

The main storage unit 902 is a read-only memory (ROM) or a random-access memory (RAM); it permanently or temporarily stores data and programs such as an operating system (OS), which is a basic software executed by the controller 901, and application software.

The auxiliary storage unit 903 is a hard disk drive (HDD) or the like; it stores data related to application software or the like.

The drive unit 904 reads out a program from a recording medium 905 such as, for example, a flexible disk and installs the read-out program in the auxiliary storage unit 903.

A given program is stored on a recording medium 905. The given program stored on the recording medium 905 is installed in the audio coding device 1 via the drive unit 904. The given program, which has been installed, is made executable by the audio coding device 1.

The network interface 906 is an interface between the audio coding device 1 and a peripheral unit having a communication function, the peripheral unit being connected to the network interface 906 through a local area network (LAN), a wide area network (WAN), or another type of network implemented by data transmission paths such as wired lines, wireless paths, or a combination of thereof.

The input unit 907 has a keyboard that includes cursor keys, numeric keys, various types of functional keys, and the like and also has a mouse and slide pad that are used to, for example, select keys on the display screen of the display unit 908. The input unit 907 is a user interface used by the user to send manipulation commands to the controller 901 and enter data.

The display unit 908, which is formed with a cathode ray tube (CRT), a liquid crystal display (LCD) or the like, provides a display according to display data supplied from the controller 901.

The audio coding processing described above may be implemented by a program executed by a computer. When the program installed from a server or the like and is executed by the computer, the audio coding processing described above may be implemented.

It is also possible to implement the audio coding processing described above by recording the program in the recording medium 905 and causing a computer or mobile terminal to read the recording medium 905 in which the program has been recorded. Various types of recording media may be used as the recording medium 905; examples of these recording media include a compact disc-read-only memory (CD-ROM), a flexible disk, a magneto-optical disk, and other types of recording media that optically, electrically, or magnetically record information and also include a ROM, a flash memory, and other types of semiconductor memories that electrically store information.

According to still another embodiment, the channel signal coder 18 in the audio coding device 1 may use another coding method to code control stereo frequency signals. For example, the channel signal coder 18 may use the AAC coding method to code a whole frequency signal. In this case, the SBR coder 19, illustrated in FIG. 1, is removed from the audio coding device 1.

Multi-channel audio signals to be coded are not limited to 5.1-channel audio signals. For example, audio signals to be coded may be audio signals having a plurality of channels such as 3-channel, 3.1-channel, and 7.1-channel audio signals. Even when an audio signal other than a 5.1-channel audio signal is to be coded, the audio coding device 1 calculates a channel-specific frequency signal by performing time-frequency conversion on a channel-specific audio signal. The audio coding device 1 then down-mixes the frequency signals in all channels and creates a frequency signal having less channels than the original audio signal.

A computer program that causes a computer to execute the functions of the units in the audio coding device 1 in each of the above embodiments may be provided by being stored in a semiconductor memory, a magnetic recording medium, an optical recording medium, or another type of recording medium.

The audio coding device 1 in each of the above embodiments may be mounted in a computer, a video signal recording apparatus, an image transmitting apparatus, or any of other various types of apparatuses that are used to transmit or record audio signals.

Fifth Example

Figure 11:
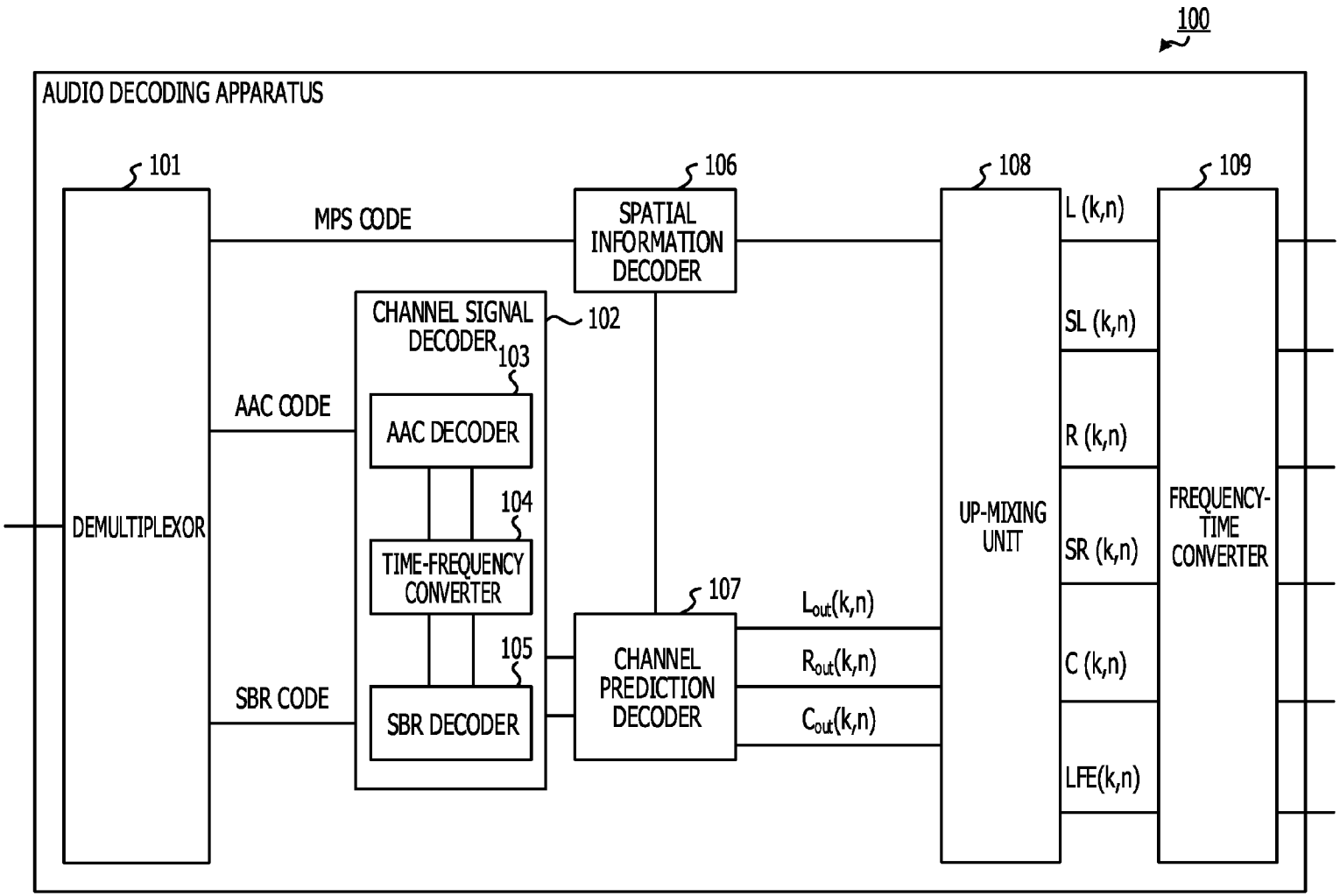
FIG. 11 is a functional block diagram of an audio decoding device according to an embodiment.

FIG. 11 is a functional block diagram of an audio decoding device 100 according to an embodiment. As illustrated in FIG. 11, the audio decoding device 100 includes a demultiplexor 101, a channel signal decoder 102, a spatial information decoder 106, a channel prediction decoder 107, an up-mixing unit 108, and a frequency-time converter 109. The channel signal decoder 102 includes an AAC decoder 103, a time-frequency converter 104, and an SBR decoder 105.

These components of the audio decoding device 100 are each formed as an individual circuit. Alternatively, these components of the audio decoding device 100 may be installed into the audio decoding device 100 as a single integrated circuit in which the circuits corresponding to these components are integrated. In addition, these components of the audio decoding device 100 may be each a functional module that is implemented by a computer program executed by a processor included in the audio decoding device 100.

The demultiplexor 101 externally receives a multiplexed coded audio signal. The demultiplexor 101 demultiplexes the coded AAC code, SBR code, and MPS code included in the coded audio signal. The AAC code and SBR code may be referred to as the channel coded signals, and the MPS code may be referred to as the coded spatial information. As a demultiplexing method, a method described in the ISO/IEC14496-3 standard may be used. The demultiplexor 101 outputs the demultiplexed MPS code to the spatial information decoder 106, the demultiplexed AAC code to the AAC decoder 103, and the demultiplexed SBR to the SBR decoder 105.

The spatial information decoder 106 receives the MPS code from the demultiplexor 101. The spatial information decoder 106 uses the table in FIG. 4, which is an example of a quantization table of similarities, to decode the similarity $ICC_i(k)$ from the MPS code and outputs the decoding result to the up-mixing unit 108. The spatial information decoder 106 uses the table in FIG. 6, which is an example of a quantization table of differences in strength, to decode a difference $CLD_j(k)$ in strength from the MPS code and outputs the decoding result to the up-mixing unit 108. The spatial information decoder 106 uses the table in FIG. 2, which is an example of a quantization table of prediction coefficients, to decode a prediction coefficient from the MPS code and outputs the decoding result to the channel prediction decoder 107.

The AAC decoder 103 receives the MPS code from the demultiplexor 101, decodes the low-frequency component of a channel-specific signal according to an AAC decoding method and outputs the decoding result to the time-frequency converter 104. As the AAC decoding method, a method described in the ISO/IEC13818-7 standard may be used.

The time-frequency converter 104 converts a channel-specific signal, which is a time signal decoded by the AAC decoder 103, to a frequency signal by using a QMF filter bank described in, for example, the ISO/IEC14496-3 standard, and outputs the converted frequency signal to the SBR decoder 105. The time-frequency converter 104 may use a complex QMF filter bank represented by the equation in Eq. 19 below to perform time-frequency conversion.

$$QMF(k, n) = \exp\left(j\frac{\pi}{128}(k+0.5)(2n+1)\right), \quad 0 \le k < 64, \quad 0 \le n < 128 \tag{19}$$

where QMF(k, n) is a complex QMF that uses time n and frequency k as variables.

The SBR decoder 105 decodes the high-frequency component of a channel-specific signal according to an SBR decoding method. As the SBR decoding method, a method described in, for example, the ISO/IEC14496-3 standard may be used.

The channel signal decoder 102 outputs the channel-specific stereo frequency signals decoded by the AAC decoder 103 and SBR decoder 105 to the channel prediction decoder 107.

The channel prediction decoder 107 performs predictive decoding on any one of the central-channel frequency signals $C_0(k, n)$ that have been subject to predictive coding from prediction coefficients received from the spatial information decoder 106 and control stereo frequency signals received from the channel signal decoder 102. For example, the channel prediction decoder 107 may perform predictive decoding on a central-channel frequency signal $C_0(k, n)$ from the control left-side frequency signal $L'_0(k, n)$ and control right-side frequency signal $R'_0(k, n)$, which are control stereo frequency signals, and the channel prediction coefficients $c_1(k)$ and $c_2(k)$, by using the equation in Eq. 20 below.

$$C_0(k,n)=c_1(k)\cdot L'_0(k,n)+c_2(k)\cdot R'_0(k,n) \tag{20}$$

The channel prediction decoder 107 outputs the control left-side frequency signal $L'_0(k, n)$, control right-side frequency signal $R'_0(k, n)$, and central-channel frequency signal $C_0(k, n)$ to the up-mixing unit 108.

The up-mixing unit 108 performs matrix conversion on the control left-side frequency signal $L'_0(k, n)$, control right-side frequency signal $R'_0(k, n)$, and central-channel frequency signal $C_0(k, n)$ received from the channel prediction decoder 107, by using the equation in Eq. 21 below.

$$\begin{pmatrix} L_{out}(k,n) \\ R_{out}(k,n) \\ C_{out}(k,n) \end{pmatrix} = \frac{1}{3}\begin{pmatrix} 2 & -1 & 1 \\ -1 & 2 & 1 \\ \sqrt{2} & \sqrt{2} & -\sqrt{2} \end{pmatrix}\begin{pmatrix} L'_0(k,n) \\ R'_0(k,n) \\ C_0(k,n) \end{pmatrix} \tag{21}$$

where $L_{out}$ (k, n) indicates a left-channel frequency signal, $R_{out}$ (k, n) indicates a right-channel frequency signal, and $C_{out}$ (k, n) indicates a central-channel frequency signal. The up-mixing unit 108 up-mixes the left-channel frequency signal $L_{out}$ (k, n), right-channel frequency signal $R_{out}$ (k, n), and central-channel frequency signal $C_{out}$ (k, n), which have been subject to matrix conversion, and spatial information received from the spatial information decoder 106 to, for example, a 5.1-channel audio signal. As an up-mixing method, a method described in the ISO/IEC23003-1 standard may be used.

The frequency-time converter 109 converts each frequency signal received from the up-mixing unit 108 to a time signal by using a QMF filter bank represented by the equation in Eq. 22 below $$IQMF(k, n) = \frac{1}{64}\exp\left(j\frac{\pi}{64}\left(k + \frac{1}{2}\right)(2n - 127)\right), \quad (22)$$
$$0 \le k < 32,$$
$$0 \le n < 32$$

As described above, the audio decoding device 100 disclosed in the fifth example may accurately decode an audio signal with error suppressed, the audio signal resulting from predictive coding.

Sixth Example

Figure 12:
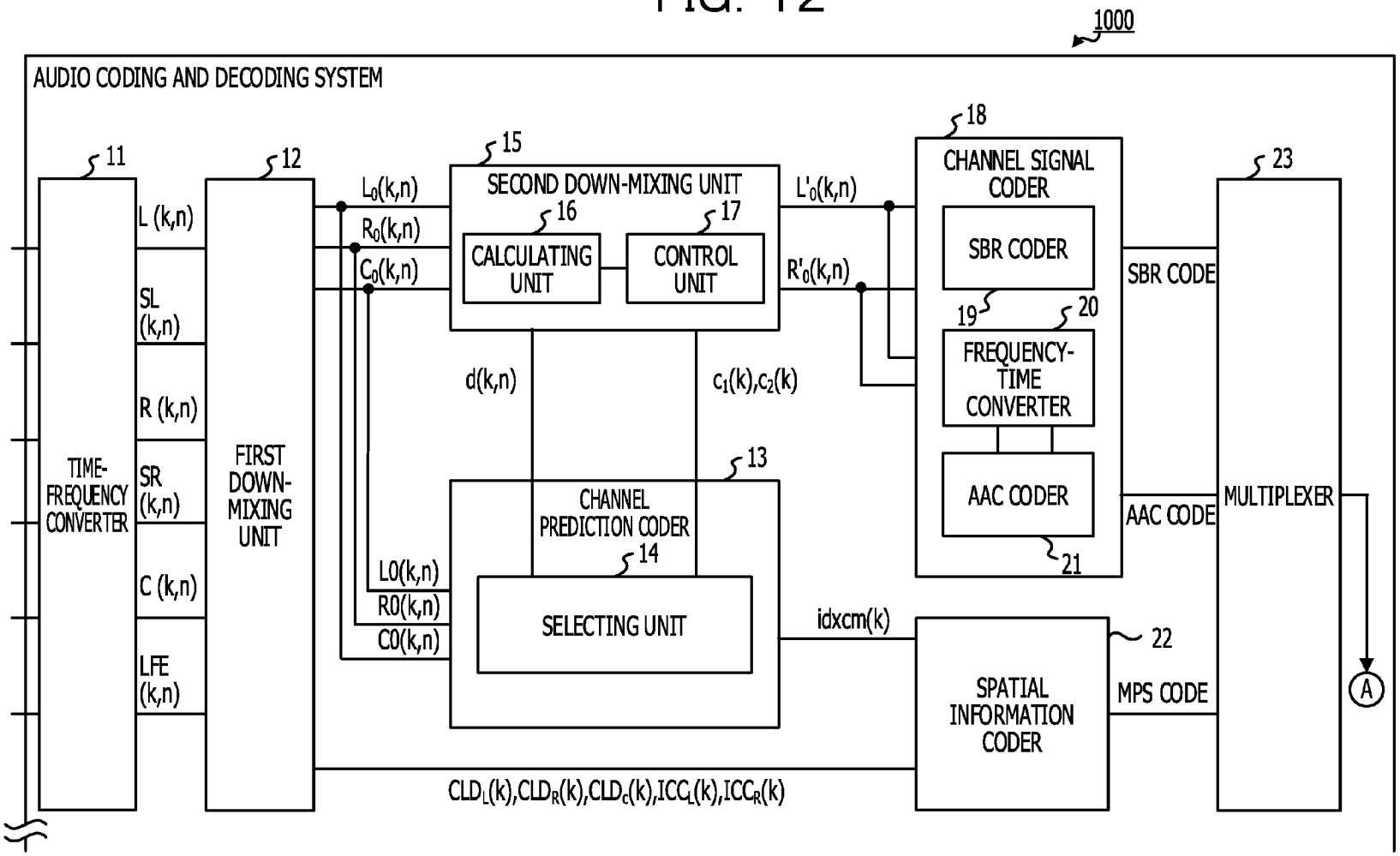
FIG. 12 is a functional block diagram of an audio coding and decoding system according to an embodiment.
Figure 13:
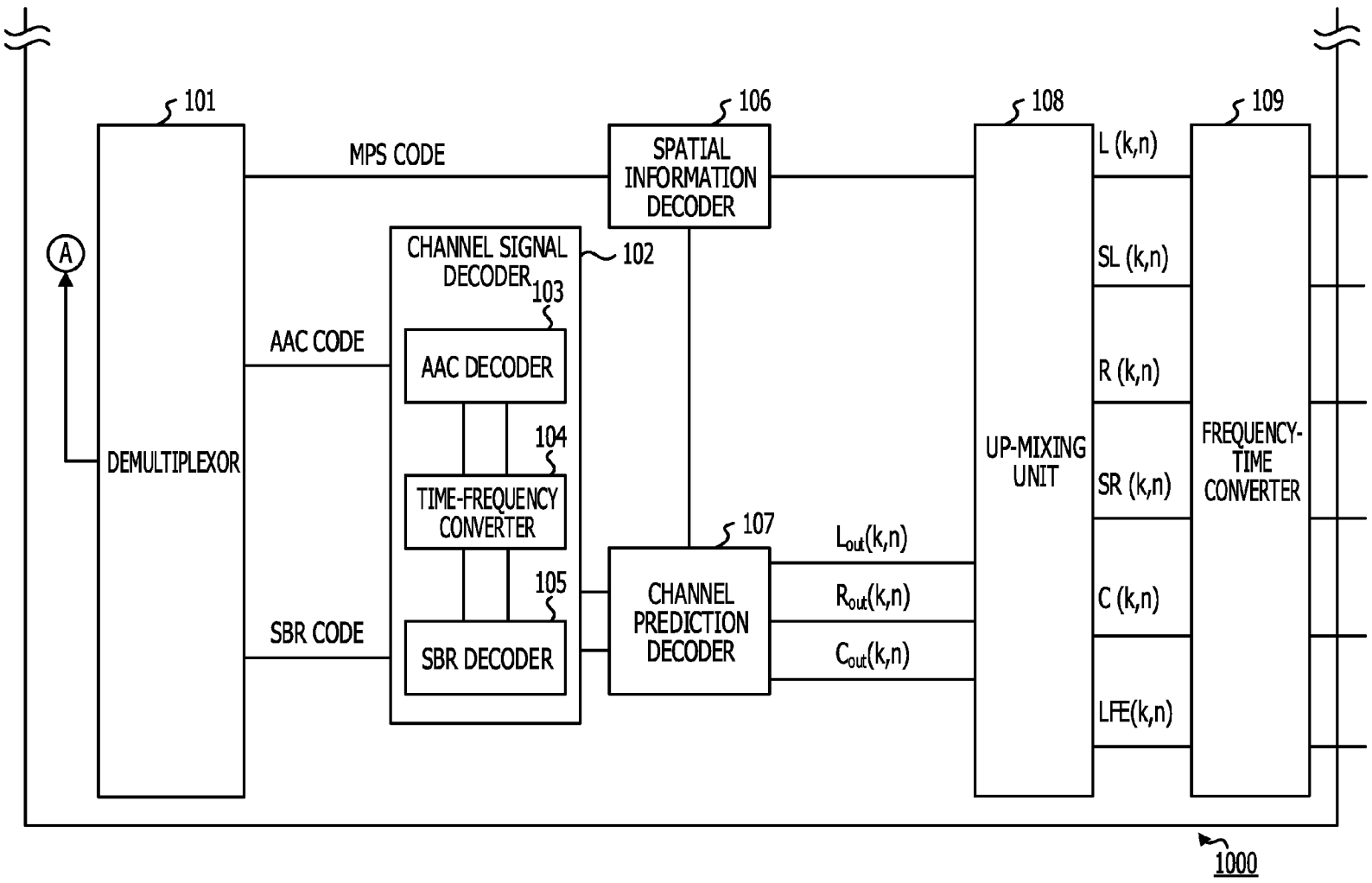
FIG. 13 is a functional block diagram, continued from FIG. 12, of the audio coding and decoding system.

FIG. 12 is a functional block diagram of an audio coding and decoding system 1000 according to an embodiment. FIG. 13 is a functional block diagram, continued from FIG. 12, of the audio coding and decoding system 1000. As illustrated in FIGS. 12 and 13, the audio coding and decoding system 1000 includes the time-frequency converter 11, first down-mixing unit 12, second down-mixing unit 15, channel prediction coder 13, channel signal coder 18, spatial information coder 22, and multiplexer 23. The channel prediction coder 13 includes the selecting unit 14. The second down-mixing unit 15 includes the calculating unit 16 and control unit 17. The channel signal coder 18 includes the SBR coder 19, frequency-time converter 20, and AAC coder 21. The audio coding and decoding system 1000 also includes the demultiplexor 101, channel signal decoder 102, spatial information decoder 106, channel prediction decoder 107, up-mixing unit 108, and frequency-time converter 109. The channel signal decoder 102 includes the AAC decoder 103, time-frequency converter 104, and SBR decoder 105. The functions included in the audio coding and decoding system 1000 are the same as the functions indicated in FIGS. 1 and 11, so their detailed description will be omitted.

The physical layouts of the components of the units illustrated in FIGS. 1, 11, and 12 in the above examples are not limited to the physical layouts illustrated in FIGS. 1, 11, and 12. That is, the specific form of distribution and integration of these components is not limited to the forms illustrated in FIGS. 1, 11, and 12. Part or all of the components may be functionally or physically distributed or integrated in a desired unit, depending on the loads and usage status.

All examples and specific terms that have appeared here are intentionally used for instructive purposes to help those skilled in the relevant art understand the concept given by the inventor to promote the present disclosure and the relevant technology. These examples and specific terms are preferably interpreted so as not to be limited to a structure in any example, related to superiority and inferiority of the present disclosure, in this description and to such a specific example and condition. Although the embodiments of the present disclosure have been described in detail, it will be appreciated that variations, replacements, and corrections may be added to the embodiments without departing from the scope of the present disclosure.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An audio coding device that performs predictive coding on a third-channel signal included in a plurality of channels in an audio signal according to a first-channel signal and a second-channel signal, which are included in the plurality of channels, and to a plurality of channel prediction coefficients included in a coding book, the device comprising:

a processor; and a memory which stores a plurality of instructions, which when executed by the processor, cause the processor to execute, selecting a first channel prediction coefficient corresponding to the first-channel signal from the coding book and a second channel prediction coefficient corresponding to the second-channel signal from the coding book so that an error, which is determined by a difference between a value of the third-channel signal before predictive coding and a value of the third-channel signal after predictive coding, is minimized;

controlling at least one of a value of the first-channel signal and a value of the second-channel signal, so that the error is further reduced, the controlling including calculating an allowable control range within which at least one of the first-channel signal and the second-channel signal is not affected in subjective sound quality and determining an amount by which at least one of the first-channel signal and the second-channel signal is controlled from the allowable control range; and calculating the value of the third-channel signal after predictive coding by combining both a first value and a second value, the first value being given by multiplying the first channel prediction coefficient by the value of the first-channel signal and the second value being given by multiplying the second channel prediction coefficient by the value of the second-channel signal.

2. The device according to claim 1, further comprising calculating a masking threshold for the first-channel signal or the second-channel signal, wherein the controlling controls the value of the first-channel signal or the value of the second-channel signal according to an allowable control amount determined by the masking threshold so that the error is further reduced.

3. The device according to claim 2, wherein the masking threshold is a quiet masking threshold or a dynamic masking threshold.

4. The device according to claim 1, wherein when the error is greater than or equal to a prescribed first threshold, the controlling controls the value of the first-channel signal or the value of the second-channel signal.

5. The device according to claim 4, wherein the first threshold is determined according to a masking threshold for the value of the third-channel signal before predictive coding.

6. The device according to claim 1, further comprising deciding whether the error is smaller than a masking threshold for the value of the third-channel signal before predictive coding; and controlling, when the error is larger than or equal to the masking threshold, the value of the first-channel signal or the value of the second-channel signal so that the error is further reduced.

7. An audio coding method in which predictive coding is performed on a third-channel signal included in a plurality of channels in an audio signal according to a first-channel signal and a second-channel signal, which are included in the plurality of channels, and to a plurality of channel prediction coefficients included in a coding book, the method comprising:

selecting a first channel prediction coefficient corresponding to the first-channel signal from the coding book and a second channel prediction coefficient corresponding to the second-channel signal from the coding book so that an error, which is determined by a difference between a value of the third-channel signal before predictive coding and a value of the third-channel signal after predictive coding, is minimized;

controlling, by a computer processor, at least one of a value of the first-channel signal and a value of the second-channel signal, so that the error is further reduced, the controlling including calculating an allowable control range within which at least one of the first-channel signal and the second-channel signal is not affected in subjective sound quality and determining an amount by which at least one of the first-channel signal and the second-channel signal is controlled from the allowable control range; and calculating the value of the third-channel signal after predictive coding by combining both a first value and a second value, the first value being given by multiplying the first channel prediction coefficient by the value of the first-channel signal and the second value being given by multiplying the second channel prediction coefficient by the value of the second-channel signal.

8. The method according to claim 7, further comprising:

calculating a masking threshold for the first-channel signal or the second-channel signal, wherein the controlling controls the value of the first-channel signal or the value of the second-channel signal according to an allowable control amount determined by the masking threshold so that the error is further reduced.

9. The method according to claim 8, wherein the first threshold is determined according to a masking threshold for the value of the third-channel signal before predictive coding.

10. The method according to claim 8, wherein the masking threshold is a quiet masking threshold or a dynamic masking threshold.

11. The method according to claim 7, wherein when the error is greater than or equal to a prescribed first threshold, the controlling controls the value of the first-channel signal or the value of the second-channel signal.

12. A non-transitory computer-readable storage medium storing an audio coding computer program that performs predictive coding on a third-channel signal included in a plurality of channels in an audio signal according to a first-channel signal and a second-channel signal, which are included in the plurality of channels, and to a plurality of channel prediction coefficients included in a coding book, the program causing a computer to execute a process comprising:

selecting a first channel prediction coefficient corresponding to the first-channel signal from the coding book and a second channel prediction coefficient corresponding to the second-channel signal from the coding book so that an error, which is determined by a difference between a value of the third-channel signal before predictive coding and a value of the third-channel signal after predictive coding, is minimized;

controlling at least one of a value of the first-channel signal and a value of the second-channel signal, so that the error is further reduced, the controlling including calculating an allowable control range within which at least one of the first-channel signal and the second-channel signal is not affected in subjective sound quality and determining an amount by which at least one of the first-channel signal and the second-channel signal is controlled from the allowable control range; and calculating the value of the third-channel signal after predictive coding by combining both a first value and a second value, the first value being given by multiplying the first channel prediction coefficient by the value of the first-channel signal and the second value being given by multiplying the second channel prediction coefficient by the value of the second-channel signal.

13. The non-transitory computer-readable storage medium according to claim 12, further comprising:

calculating a masking threshold for the first-channel signal or the second-channel signal, wherein the controlling controls the value of the first-channel signal or the value of the second-channel signal according to an allowable control amount determined by the masking threshold so that the error is further reduced.

14. The non-transitory computer-readable storage medium according to claim 13, wherein the first threshold is determined according to a masking threshold for the value of the third-channel signal before predictive coding.

15. The non-transitory computer-readable storage medium according to claim 13, wherein the masking threshold is a quiet masking threshold or a dynamic masking threshold.

16. The non-transitory computer-readable storage medium according to claim 12, wherein when the error is greater than or equal to a prescribed first threshold, the controlling controls the value of the first-channel signal or the value of the second-channel signal.

17. An audio decoding device that performs predictive coding on a third-channel signal included in a plurality of channels in an audio signal according to a first-channel signal and a second-channel signal, which are included in the plurality of channels, and to a plurality of channel prediction coefficients included in a coding book, the device comprising:

a processor; and a memory which stores a plurality of instructions, which when executed by the processor, cause the processor to execute, demultiplexing an input signal into which a coded channel signal and coded spatial information that includes a difference in strength and similarities among the plurality of channels have been multiplexed, the coded channel signal being obtained by selecting a first channel prediction coefficient corresponding to the first-channel signal from the coding book and a second channel prediction coefficient corresponding to the second-channel signal from the coding book so that an error, which is determined by a difference between a value of the third-channel signal before predictive coding and a value of the third-channel signal after predictive coding, is minimized, and then controlling at least one of a value of the first-channel signal, which is multiplied by the first channel prediction coefficient, and a value of the second-channel signal, which is multiplied by the second channel prediction coefficient, so that the error is further reduced, the controlling including calculating an allowable control range within which at least one of the first-channel signal and the second-channel signal is not affected in subjective sound quality and determining an amount by which at least one of the first-channel signal and the second-channel signal is controlled from the allowable control range; and up-mixing the first-channel signal, the second-channel signal, and the third-channel signal, on each of which decoding processing has been performed.

* * * * *